US009774136B2

(12) United States Patent
Szeto et al.

(10) Patent No.: US 9,774,136 B2
(45) Date of Patent: Sep. 26, 2017

(54) SELF-ALIGNING CONNECTOR

(71) Applicant: Nanoport Technology Inc., Markham (CA)

(72) Inventors: Timothy Jing Yin Szeto, Markham (CA); Jeremy Zhi-Qiao Chan, Markham (CA)

(73) Assignee: NANOPORT TECHNOLOGY INC., Markham (CA)

( * ) Notice: Subject to any disclaimer, the term of this patent is extended or adjusted under 35 U.S.C. 154(b) by 0 days.

(21) Appl. No.: 15/134,660

(22) Filed: Apr. 21, 2016

(65) Prior Publication Data

US 2017/0162980 A1 Jun. 8, 2017

Related U.S. Application Data

(60) Provisional application No. 62/262,357, filed on Dec. 2, 2015.

(51) Int. Cl.
*H01R 11/30* (2006.01)
*H01R 13/62* (2006.01)
*H01R 13/22* (2006.01)

(52) U.S. Cl.
CPC ..... *H01R 13/6205* (2013.01); *H01R 13/22* (2013.01)

(58) Field of Classification Search
CPC ..... H01R 13/6205; H01R 13/633; H01R 13/7175
USPC ..... 439/39, 38, 490, 180
See application file for complete search history.

(56) References Cited

U.S. PATENT DOCUMENTS

| | | | | |
|---|---|---|---|---|
| 3,363,214 | A | 1/1968 | Wright | |
| 6,561,815 | B1 | 5/2003 | Schmidt | |
| 7,311,526 | B2 | 12/2007 | Rohrbach et al. | |
| 7,322,873 | B2 | 1/2008 | Rosen et al. | |
| 7,344,380 | B2 | 3/2008 | Neidlein et al. | |
| 7,351,066 | B2 * | 4/2008 | DiFonzo | H01R 13/641 439/39 |

(Continued)

FOREIGN PATENT DOCUMENTS

| | | |
|---|---|---|
| EP | 1865581 | 4/2012 |
| WO | 2014021847 | 2/2014 |
| WO | 2014184610 | 11/2014 |

OTHER PUBLICATIONS

International Search Report and Written Opinion for PCT/CA2015/000545 dated Jan. 8, 2016.

(Continued)

*Primary Examiner* — Phuongchi T Nguyen

(57) ABSTRACT

A device may comprise a housing having a straight rounded edge. A self-aligning connector at the straight rounded edge may comprise a cylindrical magnet oriented with its axis substantially parallel to the straight rounded edge. The cylindrical magnet is for magnetically engaging a magnet of another connector so as to align and connect the self-aligning connector with the other connector. The self-aligning connector may comprise mounting structure configured to mount the cylindrical magnet at the straight rounded edge of the housing with the axis of the cylindrical magnet being substantially parallel to the straight rounded edge of the housing. The device may include two such self-aligning connectors, spaced apart from one another, along a single straight rounded edge of the device housing.

31 Claims, 15 Drawing Sheets

(56) References Cited

U.S. PATENT DOCUMENTS

| | | | | |
|---|---|---|---|---|
| 7,517,222 | B2 | 4/2009 | Rohrbach et al. | |
| 7,645,143 | B2 | 1/2010 | Rohrbach et al. | |
| 7,726,974 | B2 | 6/2010 | Shah et al. | |
| 7,901,216 | B2 * | 3/2011 | Rohrbach ..... | H01R 13/6205 439/39 |
| 8,187,007 | B2 | 5/2012 | Emde et al. | |
| 8,491,312 | B2 | 7/2013 | Rudisill et al. | |
| 8,529,274 | B2 | 9/2013 | Li et al. | |
| 8,894,419 | B1 | 11/2014 | Beulow | |
| 9,019,718 | B2 | 4/2015 | Bdeir | |
| 9,130,291 | B2 | 9/2015 | Poh | |
| 9,160,102 | B1 | 10/2015 | Morgan et al. | |
| 2005/0239261 | A1 | 10/2005 | Tai et al. | |
| 2007/0072443 | A1 | 3/2007 | Rohrbach | |
| 2012/0021619 | A1 | 1/2012 | Bilbrey et al. | |
| 2012/0068942 | A1 | 3/2012 | Lauder et al. | |
| 2012/0295451 | A1 | 11/2012 | Hyun-Jun et al. | |
| 2013/0050958 | A1 | 2/2013 | Bdeir | |
| 2013/0273752 | A1 | 10/2013 | Rudisill et al. | |
| 2013/0323941 | A1 | 12/2013 | Zeliff et al. | |
| 2014/0065846 | A1 | 3/2014 | Poh | |
| 2015/0236444 | A1 | 8/2015 | Bdeir | |

OTHER PUBLICATIONS

International Search Report and Written Opinion for PCT/CA2014/000803 dated Jan. 27, 2015.

* cited by examiner

SELF-ALIGNING CONNECTOR

CROSS-REFERENCE TO RELATED APPLICATIONS

The present application claims the benefit of prior U.S. provisional application Ser. No. 62/262,357 filed Dec. 2, 2015, the contents of which are hereby incorporated by reference hereinto.

TECHNICAL FIELD

The present disclosure relates to connectors, and more particularly to self-aligning connectors.

BACKGROUND

An electronic device, such as a mobile phone (e.g. smartphone), tablet computer, laptop computer, or the like, may incorporate various types of connectors for selective interconnection of the electronic device with other electronic devices and/or peripheral devices. The connectors may be embedded in the housing of the device, e.g. along an edge of the device. Interconnection of devices via such connectors may electrically connect or integrate the devices to provide complementary functions and may physically interconnect the devices.

Some connectors are mechanical and rely upon friction to maintain a connection. For example, a physical Universal Serial Bus (USB) 3.0 connector may conform to one of a number of industry-defined form factors, such as those referred to as Standard-A or Standard-B for example. Two devices, each having female USB 3.0 connectors conforming to either of those standards, may be electrically interconnected using a wire or cable terminated by complementary male connectors. The male connectors are physically inserted into their female counterparts and are held in place by friction.

Other connectors are magnetic. For example, commercially available MagSafe™ and MagSafe2™ connectors use magnetic attraction to maintain an electrical connection. A pair of complementary connectors (i.e. mating connectors) of this type may include a male connector having a short protrusion and a magnetized female connector having a receptacle or seat for receiving the protrusion. The male connector may be at the end of a wire or cable, and the female connector may be embedded in the housing of an electronic device.

Magnetic connectors may also be used to physically interconnect devices without a cord, with or without establishing an electrical interconnection between the devices.

It may be difficult to align connectors for interconnection, e.g. when connectors are visually obscured or when precise alignment is required for establishing a physical or electrical connection. Misalignment may interfere with proper physical or electrical interconnection of devices.

SUMMARY

According to one aspect of the present disclosure, there is provided a device comprising: a housing having a straight rounded edge; a self-aligning connector at the straight rounded edge of the housing, the self-aligning connector comprising a cylindrical magnet oriented with its axis substantially parallel to the straight rounded edge, the cylindrical magnet for magnetically engaging a magnet of an other connector so as to align and connect the self-aligning connector with the other connector.

A curved face of the cylindrical magnet may be substantially coextensive with a curved profile of the straight rounded edge of the housing.

The straight rounded edge of the housing may wrap around a curved face of the cylindrical magnet.

The cylindrical magnet may have a radius of curvature that is substantially equal to a radius of curvature of the straight rounded edge.

A diameter of the cylindrical magnet may be slightly smaller than a thickness of the device.

The straight rounded edge of the housing may have a semicircular profile that is substantially coextensive with a semicylindrical half of the cylindrical magnet.

In some embodiments, the other connector is at a straight rounded edge of an object, the straight rounded edge of the object has a semicircular profile, and, upon physical connection of the self-aligning connector with the other connector, the device is pivotable more than 270 degrees about the straight rounded edge of the object without breaking the physical connection between the self-aligning connector and the other connector.

The straight rounded edge of the housing may have a quarter-circular profile that is substantially coextensive with a quarter-cylindrical section of the cylindrical magnet.

In some embodiments, the other connector is at a straight rounded edge of an object, the straight rounded edge of the object has a quarter-circular profile, and, upon physical connection of the self-aligning connector with the other connector, the device is pivotable by 180 degrees about the straight rounded edge of the object without breaking the physical connection between the self-aligning connector and the other connector.

In some embodiments, the cylindrical magnet has an axial magnetic orientation and is fixed with respect to the housing.

In some embodiments, the cylindrical magnet has a diametric magnetic orientation and is rotatable along its axis with respect to the housing.

In some embodiments, the self-aligning connector is a first self-aligning connector, the cylindrical magnet is a first cylindrical magnet, and the device further comprises a second self-aligning connector at the straight rounded edge of the device, the second self-aligning connector comprising a second cylindrical magnet coaxial with the first cylindrical magnet of the first self-aligning connector, the second cylindrical magnet for magnetically engaging a magnet of a further connector so as to align and connect the second self-aligning connector with the further connector, the first and second self-aligning connectors being spaced apart from one another along the straight rounded edge.

The housing may be watertight and the cylindrical magnet may be encased by the watertight housing.

In another aspect of the present disclosure, there is provided a self-aligning connector for use in a device housing having a straight rounded edge, the self-aligning connector comprising: a cylindrical magnet for magnetically engaging a magnet of an other connector so as to align and connect the self-aligning connector with the other connector; and mounting structure configured to mount the cylindrical magnet at the straight rounded edge of the device housing with an axis of the cylindrical magnet being substantially parallel to the straight rounded edge of the device housing.

In some embodiments, the mounting structure is configured to position the cylindrical magnet with respect to the straight rounded edge so that a curved face of the cylindrical magnet is substantially coextensive with a curved profile of the straight rounded edge of the device housing.

In some embodiments, the mounting structure is configured to position the cylindrical magnet so that the straight rounded edge of the device housing wraps around at least a portion of a curved face of the cylindrical magnet.

The cylindrical magnet may have a radius of curvature that is substantially equal to a radius of curvature of the straight rounded edge of the device housing.

The cylindrical magnet may have a diameter that is slightly smaller than a thickness of the device housing.

In some embodiments, the straight rounded edge of the device housing has a semicircular profile and wherein the mounting structure is configured to position the cylindrical magnet with respect to the straight rounded edge so that a semicylindrical half of the cylindrical magnet is substantially coextensive with the semicircular profile of the straight rounded edge of the device housing.

In some embodiments, the straight rounded edge of the device housing has a quarter-circular profile and wherein the mounting structure is configured to position the cylindrical magnet with respect to the straight rounded edge so that a quarter-cylindrical section of the cylindrical magnet is substantially coextensive with the quarter-circular profile of the straight rounded edge of the device housing.

In some embodiments, the cylindrical magnet has an axial magnetic orientation and the mounting structure is configured to fix the cylindrical magnet with respect to the device housing.

In some embodiments, the cylindrical magnet has a diametric magnetic orientation and wherein the mounting structure is configured to allow the cylindrical magnet to rotate along its axis with respect to the device housing.

In another aspect of the present disclosure, there is provided a device having a straight rounded edge that is magnetically interconnectable with an other device so as to permit hinge-like movement of the device at the straight rounded edge while maintaining a magnetic interconnection, the device comprising: a housing having a straight rounded edge; two self-aligning connectors, spaced apart from one another, along the straight rounded edge of the housing, each of the self-aligning connectors including: a cylindrical magnet for magnetically engaging a magnet of the other device; and mounting structure configured to mount the cylindrical magnet at the straight rounded edge of the housing so that an axis of the cylindrical magnet is substantially parallel to the straight rounded edge of the housing and is coaxial with an axis of the cylindrical magnet of the other self-aligning connector.

In some embodiments, the mounting structure of each of the self-aligning connectors is configured to position the respective cylindrical magnet with respect to the straight rounded edge so that a curved face of the cylindrical magnet is substantially coextensive with a curved profile of the straight rounded edge of the housing.

In some embodiments, the mounting structure of each of the self-aligning connectors is configured to position the respective cylindrical magnet with respect to the straight rounded edge so that the straight rounded edge of the housing wraps around at least a portion of a curved face of the cylindrical magnet.

In some embodiments, the cylindrical magnet of each of the self-aligning connectors has a radius of curvature that is substantially equal to a radius of curvature of the straight rounded edge of the housing.

In some embodiments, the cylindrical magnet of each of the self-aligning connectors has a diameter that is slightly smaller than a thickness of the housing.

In some embodiments, the straight rounded edge of the housing has a semicircular profile that is substantially coextensive with a semicylindrical half of the cylindrical magnet of each of the self-aligning connectors.

In some embodiments, the straight rounded edge of the housing has a quarter-circular profile that is substantially coextensive with a quarter-cylindrical section of the cylindrical magnet of each of the self-aligning connectors.

In some embodiments, the cylindrical magnet has an axial magnetic orientation and wherein the mounting structure is configured to fix the cylindrical magnet with respect to the housing.

In some embodiments, the cylindrical magnet has a diametric magnetic orientation and wherein the mounting structure is configured to allow the cylindrical magnet to rotate along its axis with respect to the housing.

Other features will become apparent from the drawings in conjunction with the following description.

BRIEF DESCRIPTION OF THE DRAWINGS

In the figures which illustrate example embodiments.

DETAILED DESCRIPTION

In this disclosure, the terms "height," "width," "horizontal," "vertical," "left," "right," "top" and "bottom" should not be understood to necessarily imply any particular required orientation of a device or component during use. In this disclosure, the term "cylindrical magnet" should be understood to include cylindrical magnets whose heights are smaller than their radii, which magnets may alternatively be referred to as "disk magnets." In this disclosure, the term "cylindrical magnet" should be understood to include hollow cylindrical magnets, including annular or tubular magnets. Any use of the term "exemplary" should not be understood to mean "preferred."

Figure 1:
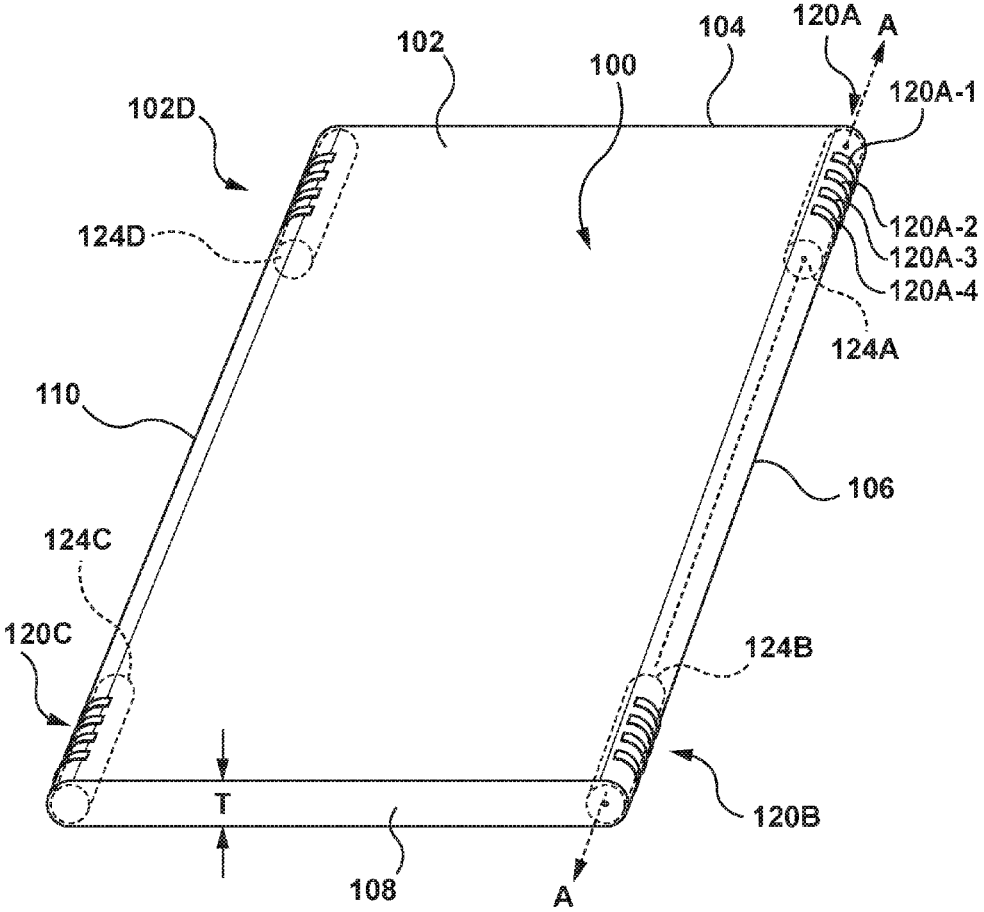
FIG. 1 is a perspective view of an electronic device having a plurality of self-aligning connectors.

Referring to FIG. 1, an example electronic device 100 is shown in perspective view. The example device 100 may be any type of electronic device or peripheral, such as a smartphone, tablet computer, laptop computer, still camera, video camera, keyboard, display, speaker, printer, scanner or router. It will be appreciated that the exact function of the device 100 is not central and that other types of electronic devices besides the ones specifically enumerated above may be used.

As shown in FIG. 1, the device 100 has a housing 102 with a generally flat cuboid shape and a thickness T. The housing 102 (FIG. 1) may be made from a non-conductive material such as plastic or anodized metal. The housing 102 has four straight edges 104, 106, 108 and 110. In this embodiment, edges 104 and 108 are flat, and edges 106 and 110 are rounded. Edges 106 and 110 may accordingly be referred to as straight rounded edges. The rounding of edges 106, 110 may be for aesthetic, ergonomic, or functional reasons, or a combination of these. In the present embodiment, the straight rounded edges 106, 110 have a semi-circular profile or cross section. In other embodiments, the straight rounded edges of a device may have profiles of different shapes (e.g. semi-elliptical, parabolic, quarter-circular, quarter-elliptical, or otherwise). The straight rounded edges 106, 110 are elongate.

Four self-aligning connectors 120A, 120B, 120C and 120D (referred to generically and collectively as self-aligning connector(s) 120) are disposed near the four corners of the device 100 respectively. In other embodiments, there may be fewer connectors per device (e.g., two rather than four), and the connectors may be placed elsewhere than the corners.

Each connector 120 is referred to as a self-aligning connector because it is designed to automatically align with a complementary connector (i.e. mating connector) when the two connectors are brought into proximity with one another. As described below, each of the self-aligning connectors uses at least one cylindrical magnet to achieve this self-aligning effect and to physically connect complementary connectors once aligned.

In the illustrated embodiment, two of the self-aligning connectors 120A, 120B are disposed along straight rounded edge 106, and two of the self-aligning connectors 120C, 120D are disposed along opposing straight rounded edge 110. Each pair of connectors 120A, 120B and 120C, 120D is spaced apart along its respective straight rounded edge 106 and 110. The spacing apart of a pair of self-aligning connectors along a given straight rounded edge may facilitate axial alignment of the straight rounded edge with a straight rounded edge of an adjacent device having a pair of complementary connectors spaced apart by the same distance when the connectors are in a connected state.

Figure 2:
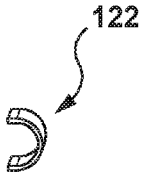
FIG. 2 is a perspective view of a single electrical contact of one of the self-aligning connectors of FIG. 1.

In addition to providing a physical connection with a complementary connector, each self-aligning connector 120 of the present embodiment also establishes an electrical connection with the complementary connector with which it is physically connected. To that end, each of the self-aligning connectors 120 in this example embodiment has four electrical contacts for carrying four electrical signals respectively. A single example electrical contact 122 in isolation is shown in FIG. 2 in perspective view. The contact is made from a conductive material and has a semi-circular or U-shape. Electrical contacts in other connector embodiments, if present, may have different shapes.

Each electrical contact of the present embodiment is embedded into the rounded edge 106 or 110. By virtue of the semi-circular or U-shape of the contact 122 (FIG. 2), the contact conforms to the semi-circular profile or contour of the semi-circular edge in which it is embedded. Each electrical contact, and the connector 120 generally, may thus be substantially flush with the rounded edge 106 or 110. The term "substantially flush" should be understood to mean either completely flush or mostly flush with the exception of a slight outward protrusion of the electrical contacts, which may be due to an outward biasing of the electrical contacts intended to promote electrical connectivity during use.

In some embodiments, the electrical contacts may form part of a flexible sheet or sleeve that wraps at least partially around the cylindrical magnet(s) comprising each connector 120. The outer surface of the sleeve may present an array of contacts for carrying power and/or data signals. The inner surface of the sleeve may be an insulator and/or provide electromagnetic shielding. The sleeve could for example be a conventional flexible flat cable (FFC).

Figure 3:
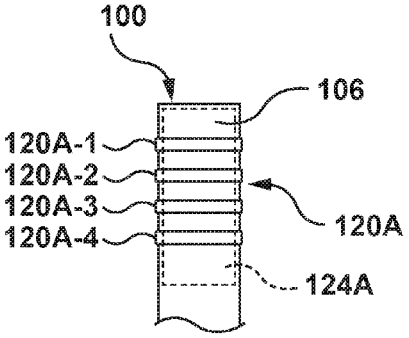
FIG. 3 is a side elevation view of one of the self-aligning connectors of FIG. 1.

In the present disclosure, the four electrical contacts of a single self-aligning connector are denoted using -1, -2, -3 and -4 suffixes appended to the relevant connector number. For example, connector 120A of FIG. 1 provides four contacts 120A-1, 120A-2, 120A-3, and 120A-4. FIG. 3 shows the four electrical contacts 120A-1, 120A-2, 120A-3 and 120A-4 of connector 120A in side elevation view. Conveniently, four contacts permit a USB 2.0 bus, comprising the standard signals Vbus, D−, D+, and GND, to be established through the connectors. In other embodiments, the number of contacts in a connector may be a positive integer greater than or less than four. In other embodiment, the number of contacts in a connector may be zero. This may be true, e.g., when the connector provides only a (self-aligned) mechanical connection function, or when electrical signals (e.g. data and/or power) are transmitted through other means, such as wirelessly or optically.

Each self-aligning connector 120A, 120B, 120C and 120D (FIG. 1) also includes a respective cylindrical magnetic element 124A, 124B, 124C and 124D (referred to collectively and generically as cylindrical magnetic element(s) 124). Each cylindrical magnetic element 124 comprises one or more cylindrical magnets. If more than once cylindrical magnet is used, the cylindrical magnets are arranged coaxially. The cylindrical magnetic element 124 produces the magnetic force that automatically aligns the connector 120 with a complementary connector, e.g. of another device, when the connectors are brought into proximity with one another, and which creates and maintains a physical connection between connectors.

The cylindrical magnet(s) comprising each self-aligning connector 120 may be rotatably or fixedly held in place within the housing 102 by a mounting structure, which is not expressly depicted in FIG. 1 but is described below. The mounting structure holds the magnet(s) of the relevant self-aligning connector so that an axis of the cylindrical magnet (or of a coaxially arranged array of cylindrical magnets) is substantially parallel to the straight rounded edge at which the self-aligning connector is disposed. Using connector 120B as an example, the mounting structure mounts the cylindrical magnet(s) of that connector's cylindrical magnetic element 124B so that axis A of the cylindrical magnet(s) is substantially parallel to straight rounded edge 106. The term "substantially parallel" means parallel or almost parallel.

The mounting structure is also configured to mount the cylindrical magnet(s) of the self-aligning connector so that an axis of the cylindrical magnet(s) is coaxial with an axis of the cylindrical magnet(s) of any other self-aligning connector disposed along the same straight rounded edge. For example, the mounting structure of connector 120B is configured to mount the cylindrical magnet(s) of cylindrical magnetic element 124B so that an axis A of the cylindrical magnet(s) is coaxial with an axis A of the cylindrical magnet(s) the cylindrical magnetic element 124A of the other self-aligning connector 120A (see FIG. 1).

Figure 4:
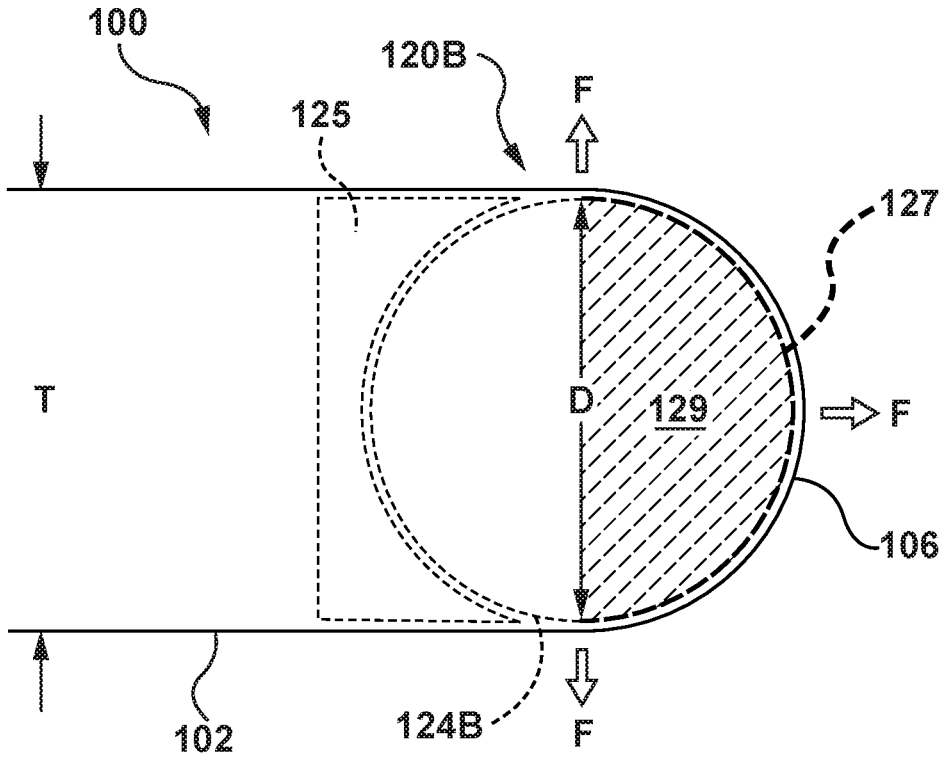
FIG. 4 is a schematic bottom view of one of the self-aligning connectors of FIG. 1.

FIG. 4 is a schematic bottom view of a portion of device 100 showing an example self-aligning connector 120B. The mounting structure 125 that mounts the cylindrical magnet(s) at the straight rounded edge 106 is depicted in dotted lines. The mounting structure 125 may take various forms and/or may be effected in various ways. The mounting structure 125 may for example be a framework, a cage, a partially or fully cylindrical receptacle, or an adhesive. The mounting structure 125B may be attached to, or may form part of, the device housing 102.

In some self-aligning connector embodiments, the mounting structure may be designed to allow the cylindrical magnet(s) comprising the cylindrical magnetic element to rotate with respect to the housing. For example, when a self-aligning connector includes a cylindrical magnet having a diametric magnetic orientation (defined below), the mounting structure of that self-aligning connector may allow that magnet to rotate with respect to the housing, e.g. so that the correct pole presents itself at the curved profile of the straight rounded edge 106 (with "correctness" possibly being determined by the polarity of the magnet of an approaching connector). In other self-aligning connector embodiments, the mounting structure may be designed to fix the cylindrical magnet(s) with respect to the housing (e.g. by way of adhesive or friction). For example, when a self-aligning connector includes a cylindrical magnet having an axial magnetic orientation (defined below), the mounting structure may fix that magnet with respect to the housing.

The cylindrical magnet(s) comprising cylindrical magnetic element 124B of example connector 120B has (have) a diameter D that is substantially equal to the thickness T of the device 100 (albeit slightly smaller than thickness T, so that the cylindrical magnetic element 124B will fit inside the housing 102). As such, the radius of curvature of the cylindrical magnetic element 124B is substantially equal to (albeit slightly smaller than) than the radius of curvature of the rounded edge 106. Substantially equal to means either equal to or almost equal to. Depending upon a strength and/or magnetic orientation of the cylindrical magnet(s) comprising the cylindrical magnetic element 124B, this may promote a strong magnetic attraction force F over the entirety of, or at least a portion of, the curved profile of the rounded edge 106.

Referring to FIG. 4, it can be seen that a curved face 127 of the cylindrical magnet(s) comprising cylindrical magnetic element 124B is substantially coextensive (i.e. either coextensive or mostly coextensive) with the curved profile of the rounded edge 106. Depending upon a strength and/or magnetic orientation of the cylindrical magnet(s) comprising the cylindrical magnetic element 124B, this may promote a strong magnetic attraction force F over the entirety of, or at least a portion of, the curved profile of the rounded edge 106.

It can be seen that, in FIG. 4, the curved profile of the rounded edge 106, which in this embodiment is semicircular, is substantially coextensive with a semicylindrical half 129 of the cylindrical magnet(s) comprising cylindrical magnetic element 124B. Depending upon a strength and/or magnetic orientation of the cylindrical magnet(s) comprising the cylindrical magnetic element 124B, this may promote a strong magnetic attraction force F over the entirety of, or at least a portion of, the curved profile of the rounded edge 106.

The rounded edge 106 of the housing 102 of the present embodiment wraps around the curved face 127 of the cylindrical magnet(s) of cylindrical magnetic element 124B. The cylindrical magnet(s) of cylindrical magnetic element 124B may be considered to be encased by the housing 102 of the present embodiment. To the extent that the housing 102 is watertight, then the cylindrical magnet(s) and/or the mounting structure 125B may be protected from possible water damage as a result. It will be appreciated that the cylindrical magnet(s) is (are) not necessarily encased by a housing in all embodiments. For example, in some embodiments, a curved face of the cylindrical magnet(s) may form part of a surface of the device or may be flush with a surface of the device housing, or may slightly protrude from a surface of the device housing.

Figure 5:
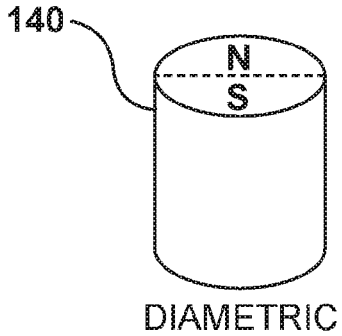
FIGS. 5 and 6 are perspective views of a diametric cylindrical magnet and an axial cylindrical magnet respectively.
Figure 6:
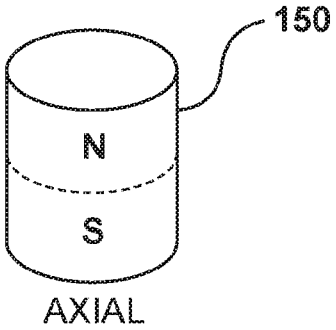

The cylindrical magnet(s) comprising the cylindrical magnetic element 124 may include one or more diametric cylindrical magnets, one or more axial cylindrical magnets, or a combination of the two. A diametric cylindrical magnet has a diametric magnetic orientation, like the example diametric cylindrical magnet 140 of FIG. 5. An axial cylindrical magnet has an axial magnetic orientation, like the example axial cylindrical magnet 150 of FIG. 6. Generally, diametric cylindrical magnets may provide a stronger attraction, while axial cylindrical magnets may provide better longitudinal alignment. Combining these magnet types may thus provide a mixture of these benefits.

Notwithstanding any disclosure herein regarding the ability of the disclosed self-aligning connector to possibly promote a strong magnetic attraction force F over the entirety of, or at least a portion of, the curved profile of the rounded edge of a device, it will be appreciated that the type of magnet (diametric or axial) and the nature of its mounting structure (fixed or permitting rotation) may impact the magnetic force profile over a curvature of the rounded edge of the device. For example, in some embodiments wherein the cylindrical magnetic element consists of one or more diametric magnets in fixed relation to the housing, the magnetic forces (fields) may be non-uniform in strength and/or orientation over the curvature of the rounded edge at which the self-aligning connectors is disposed. Accordingly, and when another connector is brought into proximity, the attractive forces F may vary over the curvature of the rounded edge in some embodiments.

The remaining self-aligning connectors 120A, 120C and 120D may have a similar design to self-aligning connector 120B.

Magnetic attraction between the cylindrical magnets of connectors 120 and the cylindrical magnets of complementary connectors in other devices promotes self-alignment of the complementary connectors relative to one another. Devices having such connectors (e.g. at an edge, as shown in FIG. 1) thus tend to self-align axially and longitudinally relative to one another when the connectors are brought together. The self-alignment effect of the connectors 120 is facilitated in various ways by the cylindrical shape of the magnet(s) comprising each connector. This is illustrated in FIGS. 7-11, which schematically depict various ways in which an example connector 120 of device 100 self-aligns with a complementary connector 220 of a similar device 220 as the connectors 120, 220 are interconnected.

Figure 7:
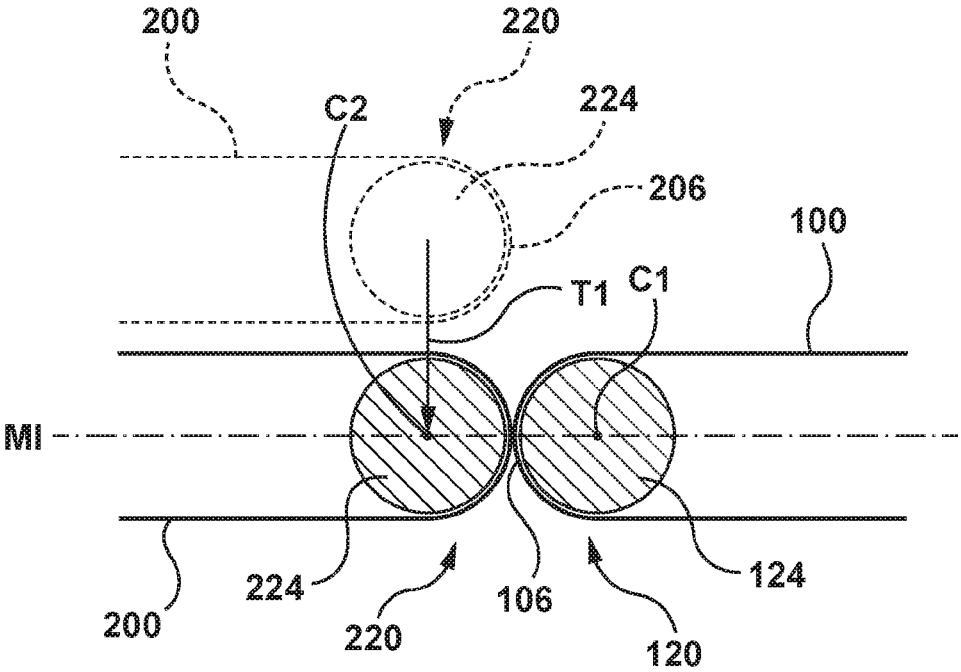
FIGS. 7-11 schematically depict various ways in which an example connector of the device of FIG. 1 self-aligns with a complementary connector of a similar device.
Figure 8:
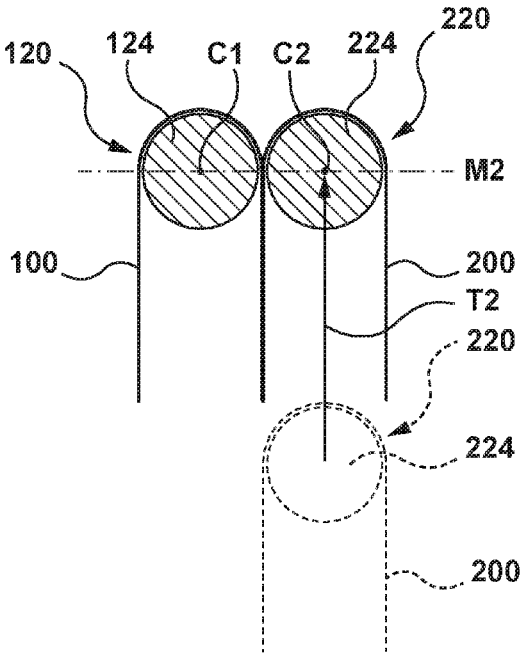

FIGS. 7 and 8 are schematic top views of portions of devices 100, 200 illustrating self-alignment of example connectors 120, 220 relative to the circle center of their respective cylindrical magnetic elements 124, 224, in two different scenarios.

In a first scenario shown in FIG. 7, devices 100, 200 initially occupy different planes and are then brought together to occupy the same plane, so that rounded edges 106, 206 physically interconnect upon connection of the magnetic connectors 120, 220. As illustrated, when the connector 220 is moved along trajectory T1 into proximity with connector 120, the cylindrical magnetic element 124 of connector 120 pulls the complementary cylindrical magnetic element 224 downwardly into alignment with itself relative to the circle center C1 of element 124 (with the caveat that cylindrical magnetic element 224 may actually be pulled diagonally, i.e. downward and to the right, in FIG. 7, since the diagonal trajectory is the shortest distance between center points C1, C2 of the two cylindrical magnets). Upon interconnection as shown in FIG. 7, the circle center C2 of cylindrical magnetic element 224 will occupy a notional midline of the devices 100, 200 that also passes through circle center C1.

In a second scenario shown in FIG. 8, devices 100, 200 are oriented face-to-face with connectors 120, 220 initially being vertically offset. As device 200 moves upwardly along trajectory T2 in FIG. 8, the cylindrical magnetic element 124 of connector 120 pulls the cylindrical magnetic element 224 upwardly until circle center C2 of cylindrical magnetic element 224 is aligned with circle center C1 of cylindrical magnetic element 124, so that both centers occupy notional horizontal centerline M2.

Figure 9:
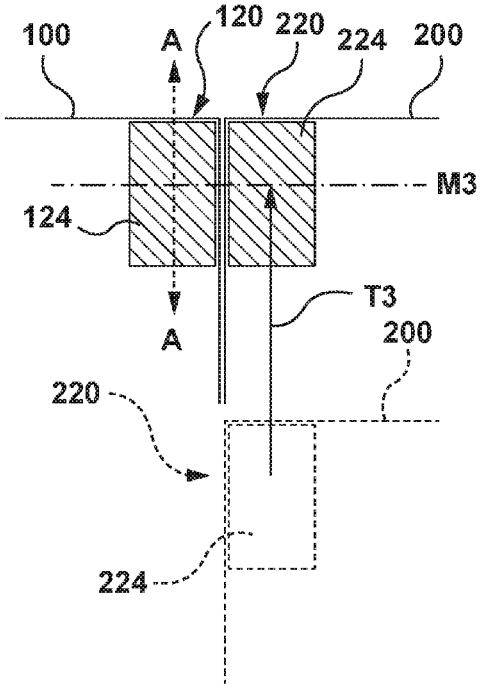

FIG. 9 illustrates longitudinal self-alignment of connectors 120, 220, i.e. alignment in the longitudinal dimension of the cylindrical magnetic elements 124, 224 (which in turn promotes longitudinal self-alignment of the devices 100, 200). In FIG. 9, the devices 100, 200 are oriented edge-to-edge with connectors 120, 220 initially being vertically offset. As device 200 moves upwardly along trajectory T3, the cylindrical magnetic element 124 pulls the cylindrical magnetic element 224 upwardly towards itself until the connectors 120, 220 align relative to a horizontal centerline M3 transversely bisecting both magnets.

The tendency of connectors 120, 220 to longitudinally self-align in FIG. 9 may be enhanced, i.e. the connectors 120, 220 may have the greatest tendency to align relative to a common horizontal centerline M3, when: (a) the cylindrical magnetic elements 124, 224 contain at least one complementary pair of magnets of the axial type; or (b) each of the cylindrical magnetic elements 124, 224 includes a plurality of cylindrical magnets (whether axial, diametric, or both) in a spaced array that destabilizes longitudinally misaligned positions (described below).

In contrast, the connectors' tendency to longitudinally self-align may be slightly less strong when the cylindrical magnetic elements 124, 224 include only a single complementary pair of cylindrical magnets of the diametric type. In such embodiments, the connectors 120, 220 could conceivably achieve a stable connected position even when the cylindrical magnetic elements 124, 224 are slightly longitudinally misaligned. Such misalignment could, in some embodiments, jeopardize proper electrical connectivity between connectors having electrical contacts but may be satisfactory for physically interconnecting devices for other applications. Thus the choice of cylindrical magnets, and their arrangement, for any particular connector embodiment may be based, at least in part, upon a permissible degree of longitudinal connector offset (if any) for the application in question.

Figure 10:
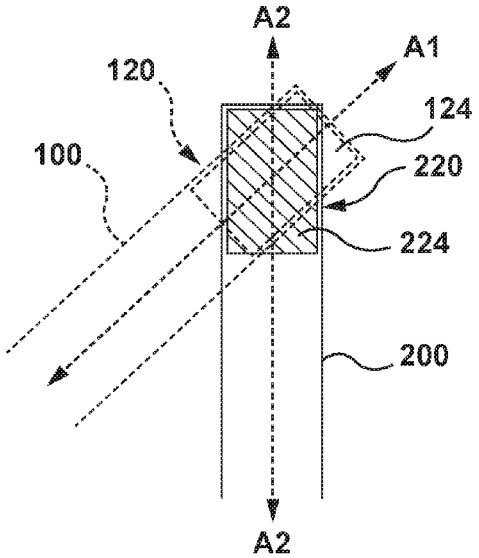
Figure 11:
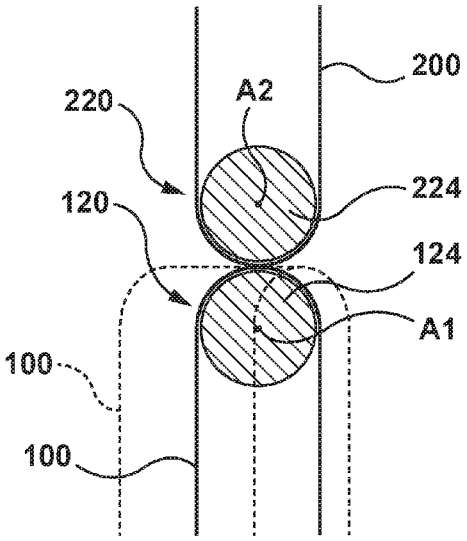

FIGS. 10 and 11 illustrate the tendency of connectors 120, 220 to axially self-align, i.e. to attain a connected state in which the (longitudinal) axes of respective cylindrical magnetic elements 124, 224 are parallel to one another (which in turn promotes axial self-alignment of the devices 100, 200).

FIG. 10 is a schematic side elevation view showing device 100 (in dashed lines) and device 200 (in solid lines). In FIG. 10, connectors 120, 220 are in contact with one another, but device 100 is angled with respect to device 200 so that the axes A1, A2 of respective cylindrical magnetic elements 124, 224 are initially non-parallel. In other words, connectors 120, 220 are initially axially misaligned in FIG. 10.

Turning to FIG. 11, which is a schematic top view of the same portions of devices 100, 200 shown in FIG. 10, it can be seen that mutual magnetic attraction between the cylindrical magnetic elements 124, 224 rotates connector 120 and associated device 100 so as to bring cylindrical magnetic elements 124, 224 into axial alignment, i.e. brings axis A1 parallel to axis A2.

It is noted that, in each of self-alignment scenarios discussed above and illustrated FIGS. 7-11, a first device 100 or 200 is shown in the drawings as remaining stationary and a second device 200 or 100 is shown to move as it aligns with the first. This is done for the sake of clarity. In practice, each device 100, 200 may move with respect to the other during self-alignment, because mutual magnetic attraction between complementary connectors 120, 220 may cause each device to jump or snap towards the other.

Figure 12:
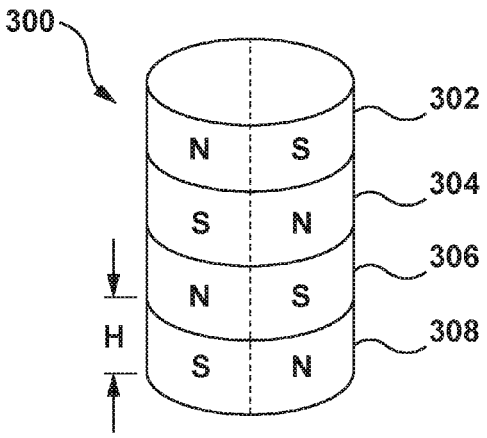
FIG. 12 is a perspective view of an example cylindrical magnetic element of a self-aligning connector comprising four diametric cylindrical magnets arranged coaxially.

As noted above, each cylindrical magnetic element 124 may comprise a plurality or array of cylindrical magnets arranged coaxially. FIG. 12 shows an example cylindrical magnetic element 300 made up of four cylindrical magnets 302, 304, 306 and 308 arranged coaxially. In alternative embodiments, number of cylindrical magnets in other embodiments may be greater than or less than four.

As shown in FIG. 12, the four cylindrical magnets 302, 304, 306 and 308 of this example cylindrical magnetic element are of the diametric type and are of equal size and shape, thus having uniform heights H (longitudinal extents or thicknesses). The four magnets are arranged with alternating magnetic orientations to facilitate magnetic attraction between adjacent magnets.

In an alternative embodiment, all of the magnets may be of the axial type. In that case, the magnets may be arranged with each magnet in the same orientation, e.g. N pole on top, S pole on the bottom, to facilitate magnetic attraction between adjacent magnets. In a further alternative, a cylindrical magnetic element may contain both axial magnets and diametric magnets. As noted above, the use of one or more axial magnets may enhance the longitudinal self-aligning effect, e.g. as discussed above in relation to FIG. 9.

FIGS. 13-27 illustrate various embodiments of cylindrical magnetic elements in which multiple cylindrical magnets are spaced apart into a spaced array.

Figure 13:
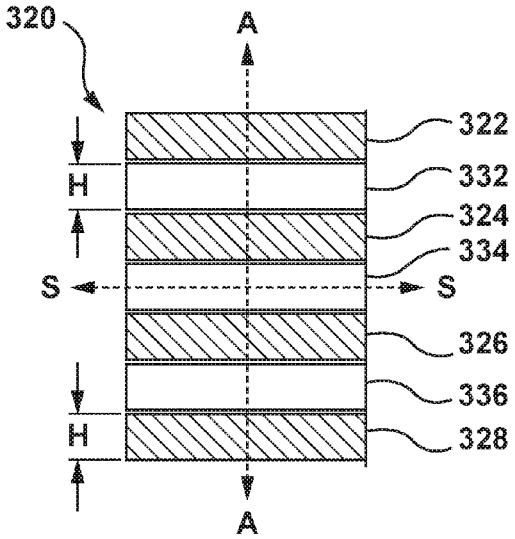
FIG. 13 is a schematic side elevation view of another example cylindrical magnetic element of a self-aligning connector comprising a spaced array of cylindrical magnets.

FIG. 13 is a side elevation view of one example cylindrical magnetic element 320 of a notional connector (connector not expressly shown). The cylindrical magnetic element 320 comprises four cylindrical magnets 322, 324, 326 and 328 of equal size and shape (thus having uniform heights H) arranged coaxially. The cylindrical magnetic element 320 further includes three uniform spacers 332, 334 and 336 between neighboring ones of the cylindrical magnets 322, 324, 326 and 328 respectively. Each spacer is made from a non-magnetic and non-ferrous material, such as nylon, plastic, or rubber for example. Collectively, the spacers 332, 334 and 336 may be considered as a non-magnetic spacing structure for spacing apart the cylindrical magnets 332, 334, 336, 338 into the spaced array shown in FIG. 13. The spacers may be shims.

In the illustrated embodiment, the height (i.e. thickness or longitudinal extent) of each spacer 332, 334 and 336 matches the height (i.e. thickness or longitudinal extent) of a cylindrical magnet, which is denoted H in FIG. 13. In other words, the spacing of the cylindrical magnets in the spaced array is regular: all neighboring magnets in the arrangement are spaced apart equally. This is not necessarily true in alternative embodiments, as will be shown below.

The cylindrical magnetic element 320 of this embodiment may be considered to provide a spaced array of cylindrical magnets that is longitudinally symmetric. The term "longitudinally symmetric" in this context means symmetric relative to a plane of symmetry S that transversely bisects cylindrical magnetic element 300 and to which longitudinal axis A of the cylindrical magnetic element 300 is normal.

Figure 14:
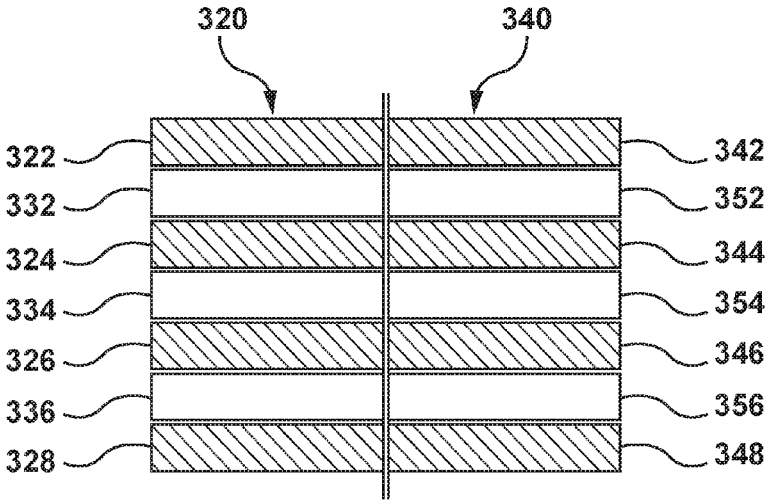
FIG. 14 is a schematic side elevation view of the spaced array of cylindrical magnets of FIG. 13 aligned with a complementary spaced array of cylindrical magnets of a complementary connector.
Figure 15A:
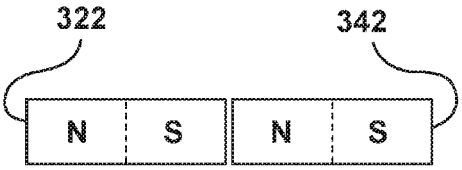
FIG. 15A is a schematic side elevation view of a pair of complementary diametric cylindrical magnets.
Figure 15B:
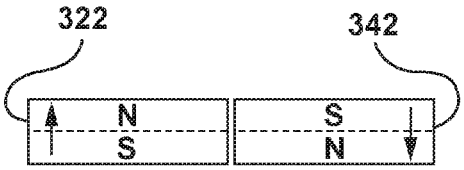
FIG. 15B is a schematic side elevation view of a pair of complementary axial cylindrical magnets.

FIG. 14 schematically depicts, in side elevation view, the cylindrical magnetic element 320 of FIG. 13 when connected with a complementary cylindrical magnetic element 340 of a complementary notional connector. In FIG. 14, each cylindrical magnet 322, 324, 326 and 328 comprising cylindrical magnetic element 320 is longitudinally aligned and magnetically interconnected with a respective complementary cylindrical magnet 342, 344, 346 and 348 comprising cylindrical magnetic element 340.

What constitutes a "complementary cylindrical magnet" for a cylindrical magnet depends upon the type of cylindrical magnet (diametric versus axial) and its magnetic orientation. Using cylindrical magnet 322 as an example and with reference to FIG. 15A, if the cylindrical magnet 322 is a diametric magnet oriented with its N pole on the left and its S pole on the right, then the complementary cylindrical magnet 342 will also be a diametric magnet with its N pole on the left and the S pole on the right, so that the connecting faces of the magnets will have opposite poles. In a second example shown in FIG. 15B, if the example cylindrical magnet 322 is an axial magnet with its N pole facing upwardly, then the complementary cylindrical magnet 342 will be an axial magnet with its N pole facing downwardly.

When a spaced array of cylindrical magnets comprising a connector self-aligns and connects with a complementary spaced array of cylindrical magnets of a complementary connector as shown in FIG. 14, the connectors will tend to be longitudinally stable with respect to one another. Application of a small longitudinal force upon one of the connectors will not tend to longitudinally displace the cylindrical magnetic elements 320, 340 from one another, particularly when at least one complementary pair of cylindrical magnets is of the axial type. This is true despite the fact that the connectors may be substantially or completely flush with the surfaces of the devices in which they are embedded.

Figure 16:
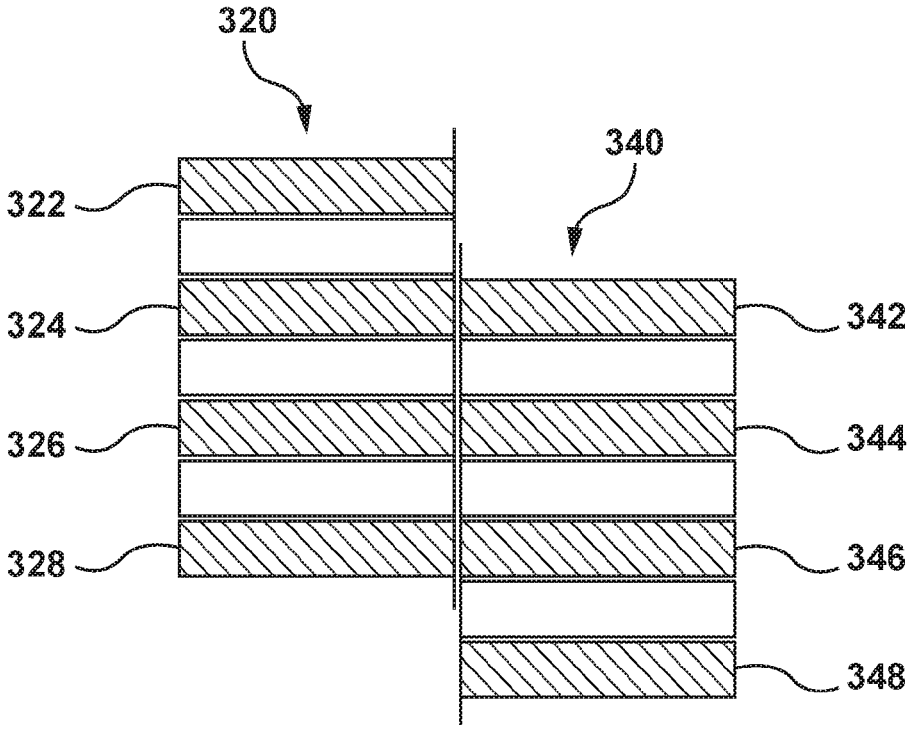
FIG. 16 is a schematic side elevation view of the spaced array of cylindrical magnets of FIG. 13 misaligned with a complementary spaced array of cylindrical magnets of a complementary connector.

Notwithstanding the longitudinal self-aligning properties described above, it some circumstances, longitudinal misalignment of a connector may still be possible. For example, FIG. 16 schematically depicts a possible longitudinal misalignment of the cylindrical magnetic elements 320, 340 of FIG. 14. In FIG. 16, a majority (three out of four) of the complementary magnet pairs are aligned despite the overall misalignment of the connectors. In particular, magnet pairs 324 and 342; 326 and 344; and 328 and 346 are aligned, but magnets 322 and 348 are misaligned. The notional connectors comprising the cylindrical magnetic elements 320, 340 are thus connected and relatively stable despite being misaligned. Such a misaligned but relatively stable interconnection between cylindrical magnetic elements may disadvantageously compromise proper physical and/or electrical connection between connectors and/or devices in some embodiments.

One way in which the longitudinal self-aligning effect may be enhanced may be to arrange the cylindrical magnets into a spaced array in which the spacing is irregular. This is illustrated in FIG. 17.

Figure 17:
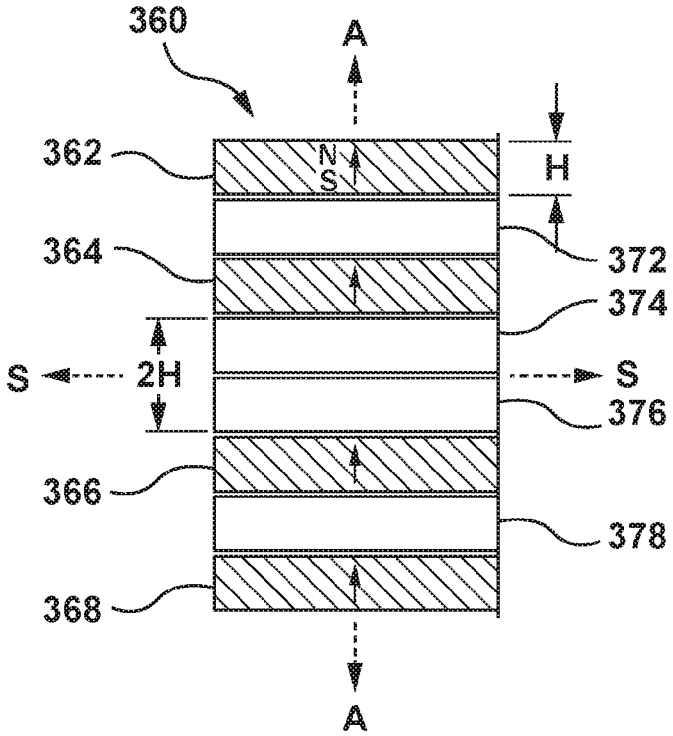
FIG. 17 is a schematic side elevation view of another example cylindrical magnetic element of a self-aligning connector comprising a differently spaced array of cylindrical magnets.

FIG. 17 is schematic depiction, in side elevation view, of an alternative cylindrical magnetic element 360 of another notional connector. Like cylindrical magnetic element 340 of FIG. 13, the cylindrical magnetic element 360 of FIG. 17 comprises four cylindrical magnets 362, 364, 366 and 368 arranged coaxially. The magnets are of equal size and shape and thus have uniform heights H. In this example, the magnets are axial magnets, each having the same polarity.

The cylindrical magnetic element 360 of FIG. 17 includes one spacer between each pair of neighboring cylindrical magnets, with the spacers having a uniform height H (thickness). An exception is that one additional spacer has been inserted between the middle two magnets 364, 366, thereby doubling the space between these two magnets in comparison to the space between the other neighboring magnets.

In view of the doubling of the space between magnets 364 and 366, the spacing of the cylindrical magnets in the arrangement of FIG. 17 is irregular, i.e. some neighboring magnets are spaced apart further than others. Note that, despite this irregularity, the spaced array of magnets of FIG. 17, like that of FIG. 13, is longitudinally symmetric, i.e. symmetric relative to a plane of symmetry S that transversely bisects cylindrical magnetic element 360 and to which longitudinal axis A of the cylindrical magnetic element 300 is normal. As will be appreciated, longitudinal symmetry alone may not be a good predictor of whether a particular spaced array of cylindrical magnets will or will not allow complementary connectors to interconnect relatively stably in longitudinally misaligned positions.

Figure 18:
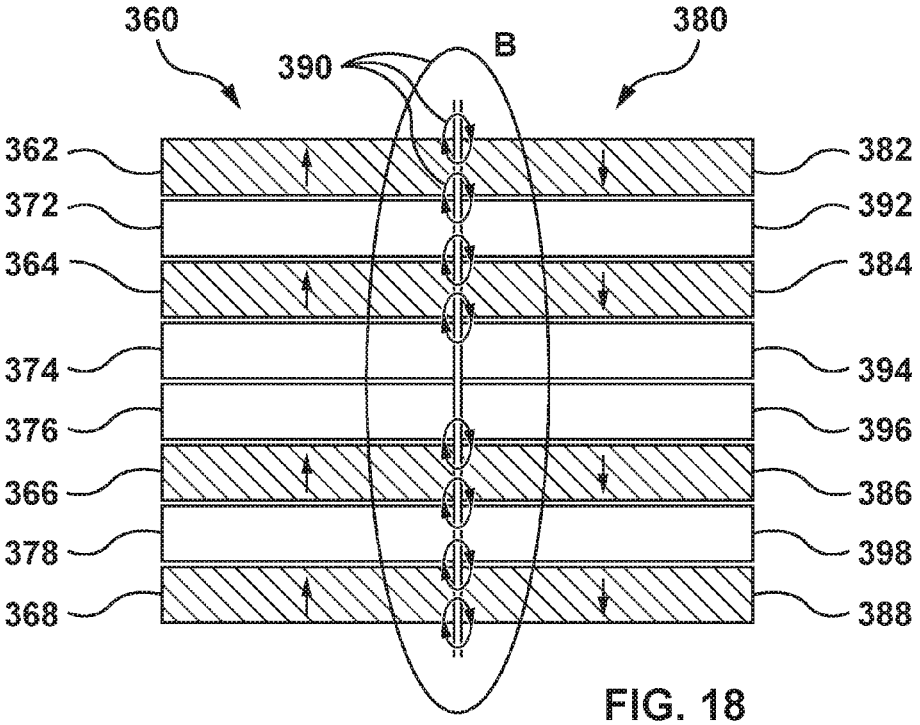
FIG. 18 is a schematic side elevation view of the spaced array of cylindrical magnets of FIG. 17 aligned with a complementary spaced array of cylindrical magnets of a complementary connector.

FIG. 18 schematically depicts, in side elevation view, the cylindrical magnetic element 360 of FIG. 17 longitudinally aligned and connected with a complementary cylindrical magnetic element 380 of another notional connector. In FIG. 18, each cylindrical magnet 362, 364, 366 and 368 comprising cylindrical magnetic element 360 is longitudinally aligned and magnetically interconnected with a respective complementary cylindrical magnet 382, 384, 386 and 388 comprising cylindrical magnetic element 380. Magnetic flux lines 390 are also depicted in FIG. 18.

As a consequence of doubling the space between magnets 364 and 366, when the connectors are misaligned, at most one-half of the cylindrical magnets of each connector (i.e. two magnets of four in this embodiment) will align with complementary magnets of the other connector. This is true regardless of the degree of longitudinal misalignment of the connectors, i.e. regardless of the degree of longitudinal misalignment of cylindrical magnetic elements 360 and 380.

Figure 19:
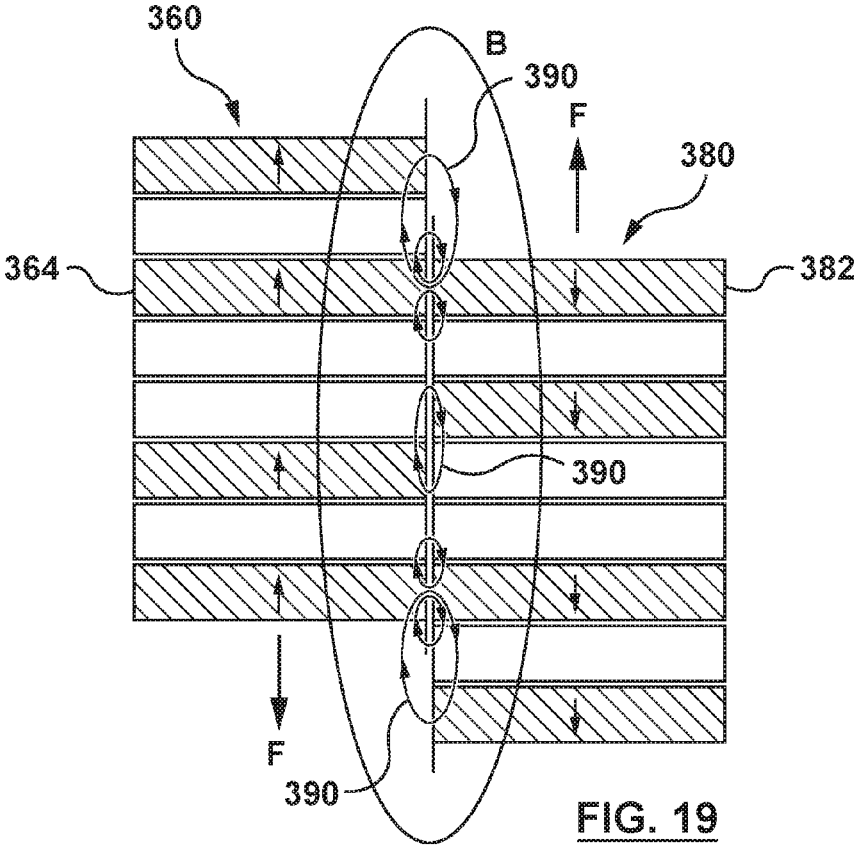
FIGS. 19 and 20 are schematic side elevation views of the spaced array of cylindrical magnets of FIG. 17 in two different misalignment positions with respect to a complementary spaced array of cylindrical magnets of a complementary connector.

For example, one possible longitudinal misalignment scenario is schematically depicted in FIG. 19. Example magnetic flux lines 390 are again shown. As can be seen, several magnetic flux lines have lengthened along an axis parallel to the connection surface (i.e. longitudinally) in relation to the longitudinally aligned scenario of FIG. 18. This lengthening of flux lines reflects the presence of opposing net magnetic forces F that tend to pull the cylindrical magnetic elements 360, 380, and thus their respective connectors, towards alignment in a direction parallel to the connection surface. In other words, the forces F destabilize the misaligned position of FIG. 19, reflecting an enhanced tendency of the connectors to longitudinally self-align.

Figure 20:
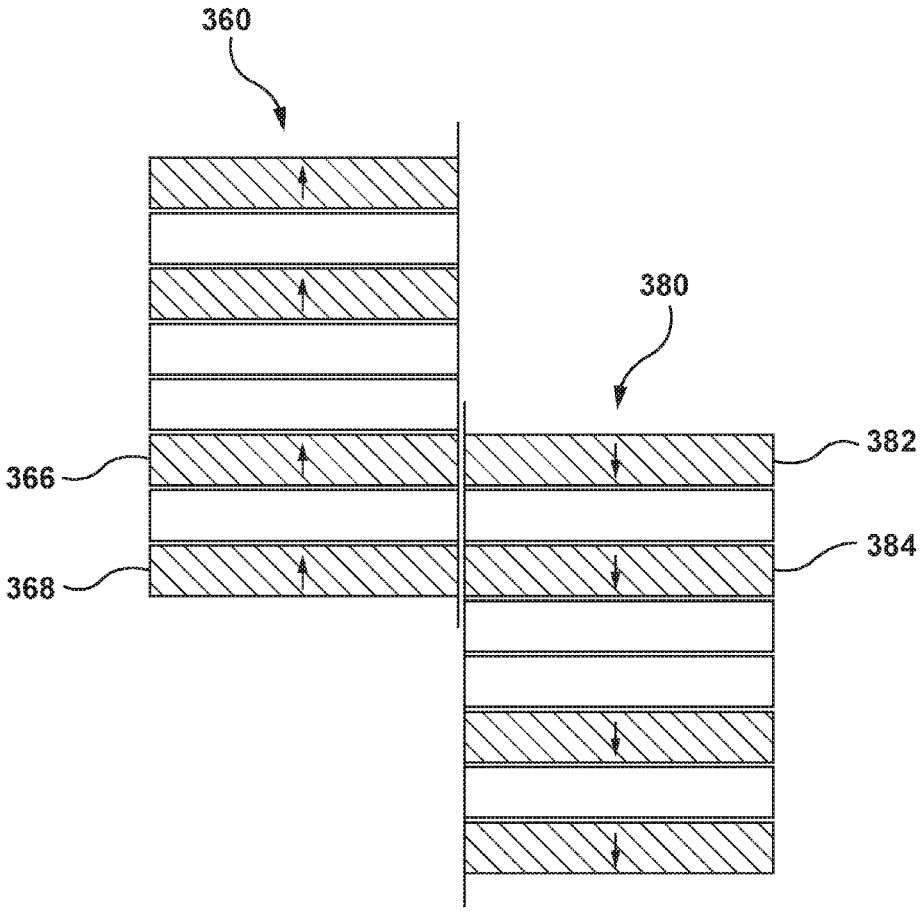

Another possible misaligned position of the cylindrical magnetic elements 360, 380 in which two magnet pairs are aligned is shown in FIG. 20. In this example, cylindrical magnet pairs 366, 382 and 368, 384 are aligned, and the remaining cylindrical magnet pairs are misaligned.

The doubled spacing between cylindrical magnets need not be at the middle of the connector in order to provide the enhanced self-alignment benefits discussed above. The doubled spacing could instead be towards the top (e.g., between the first and second magnets), or towards the bottom (e.g., between the third and fourth magnets), of the connector. The former is shown in FIG. 21.

Figure 21:
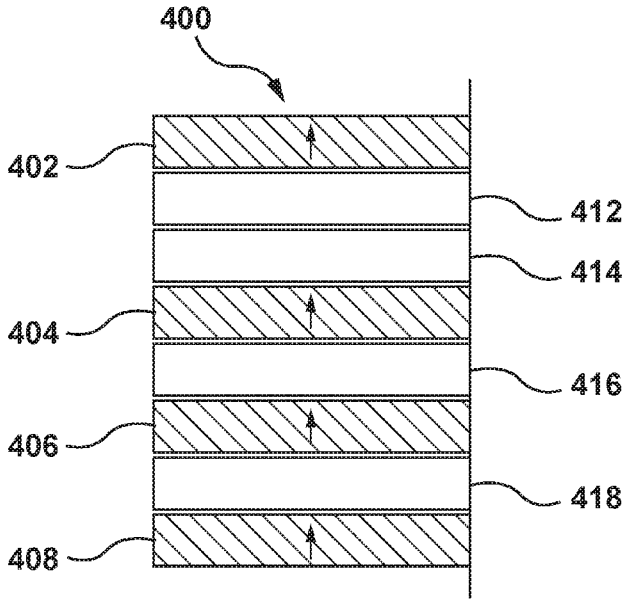
FIG. 21 is a schematic side elevation view of still another example cylindrical magnetic element of a self-aligning connector comprising another differently spaced array of cylindrical magnets.

FIG. 21 schematically depicts, in side elevation view, an alternative cylindrical magnetic element 400 in which the doubled spacing is between the uppermost two magnets 402, 404 of the array rather than the middle two magnets. It will be appreciated that the spacing of cylindrical magnets 402, 404, 406 and 408 by way of interleaved spacers 412, 414, 416 and 418 is both irregular and longitudinally asymmetric in this embodiment.

Figure 22:
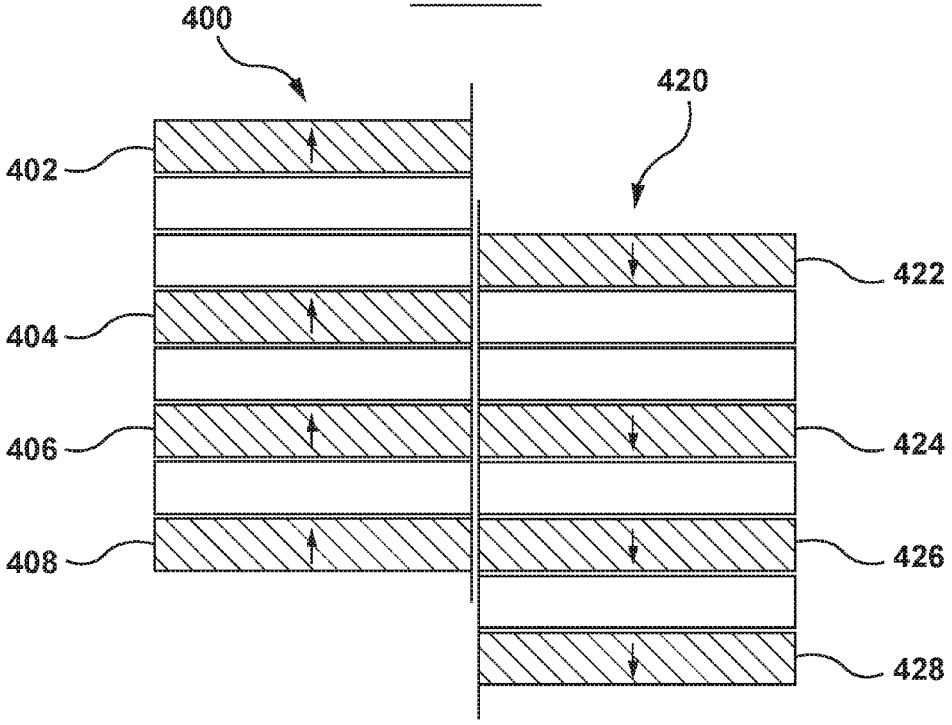
FIG. 22 is a schematic side elevation view of the spaced array of cylindrical magnets of FIG. 21 misaligned with a complementary spaced array of cylindrical magnets of a complementary connector.

Like the embodiment discussed above in conjunction with FIGS. 17-19, the embodiment of FIG. 21 permits at most one-half of the cylindrical magnets (i.e. two magnets of four) to align with complementary magnets of the other connector when the connectors are longitudinally misaligned, regardless of the degree of longitudinal misalignment of the connectors. An exemplary misaligned position of the cylindrical magnetic element 400 with a complementary cylindrical magnetic element 420, in which two magnet pairs are aligned, is shown in FIG. 22. In that example, magnet pairs 406, 424 and 408, 426 are aligned, and the remaining magnets are misaligned.

Figure 23:
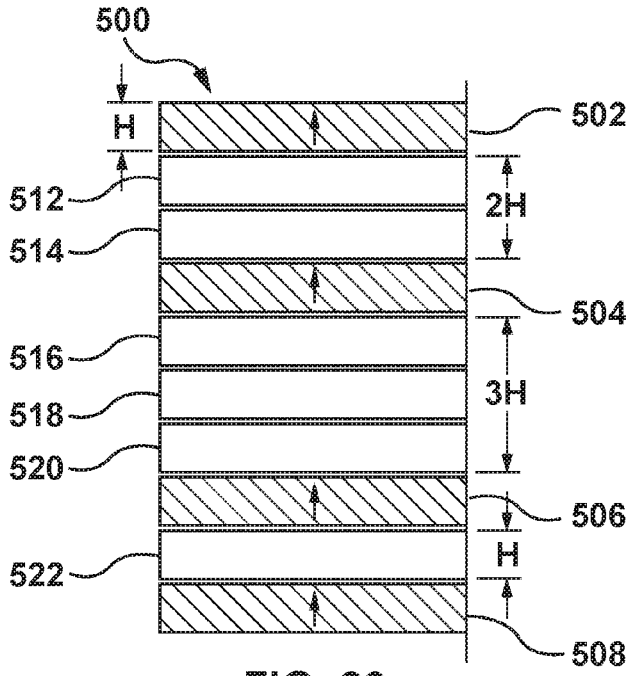
FIG. 23 is a schematic side elevation view of yet another example cylindrical magnetic element of a self-aligning connector comprising another differently spaced array of cylindrical magnets.

FIG. 23 is schematic depiction, in side elevation view, of yet another alternative cylindrical magnetic element 500 of a notional connector. As with the other embodiments 320, 340, 360 and 380 discussed above, cylindrical magnetic element 500 of FIG. 23 comprises four cylindrical magnets 502, 504, 506 and 508 arranged coaxially. The magnets are of equal size and shape and thus have uniform heights H. The exemplary magnets are axial magnets, each having the same polarity. Moreover, the cylindrical magnetic element 500 includes at least one spacer of uniform size interposed between neighboring ones of the cylindrical magnets.

However, unlike the cylindrical magnetic element embodiments 320, 340, 360 and 380 discussed above, the number of spacers interposed between neighboring magnets of the spaced array is unique for each neighboring magnet pair.

The unique spacing between each magnet pair may perhaps best be appreciated when the spaced array of cylindrical magnets is represented as a textual expression using the following notation: each instance of the letter "M" represents a cylindrical magnet of uniform height H; each instance of an integer represents that number of side-by-side spacers, each spacer of the same uniform height H as a magnet; and a colon (":") represents a junction between a spacer and a cylindrical magnet.

Using that notation, the spaced array of magnets of cylindrical magnetic element 500 of FIG. 23 may be denoted using the following textual expression:

M:2:M:3:M:1:M wherein:

the first "M" represents magnet 502 of FIG. 23;

the "2" represents the two spacers 512 and 514 of FIG. 23;

the second "M" represents magnet 504 of FIG. 23;

the "3" represents the three spacers 516, 518 and 520 of FIG. 23;

the third "M" represents magnet 506 of FIG. 23;

the "1" represents the spacers 522 of FIG. 23; and the fourth "M" represents magnet 504 of FIG. 23.

As will be observed from the unique integer values in the above expression, the spacing between each pair of neighboring magnets of FIG. 23 is unique. By virtue of that unique spacing, and given the fact that each space is a multiple of magnet height H, whenever a connector having the cylindrical magnetic element 500 is longitudinally misaligned with a complementary connector, at most a single magnet will align with a corresponding magnet of the other connector. This will be true regardless of the degree of longitudinal misalignment between connectors.

The cylindrical magnetic element embodiment of FIG. 23 may accordingly further destabilize longitudinally misaligned connector positions in relation to the embodiments depicted in FIGS. 17-22, by increasing the forces pulling the misaligned connectors towards alignment. This benefit may come at the cost an increased length of the cylindrical magnetic element 500, e.g. presuming magnet and spacer sizes remain the same. Such an increase in length may or may not be feasible for a particular connector and/or device embodiment, depending upon connector/device size constraints or other factors. Thus, when each cylindrical magnet comprising a connector is of uniform height H, and when each space between magnets is unique and constitutes a positive integer multiple of magnet heights H, then only one magnet pair will be aligned regardless of the manner in which the connectors are longitudinally misaligned.

Figure 24:
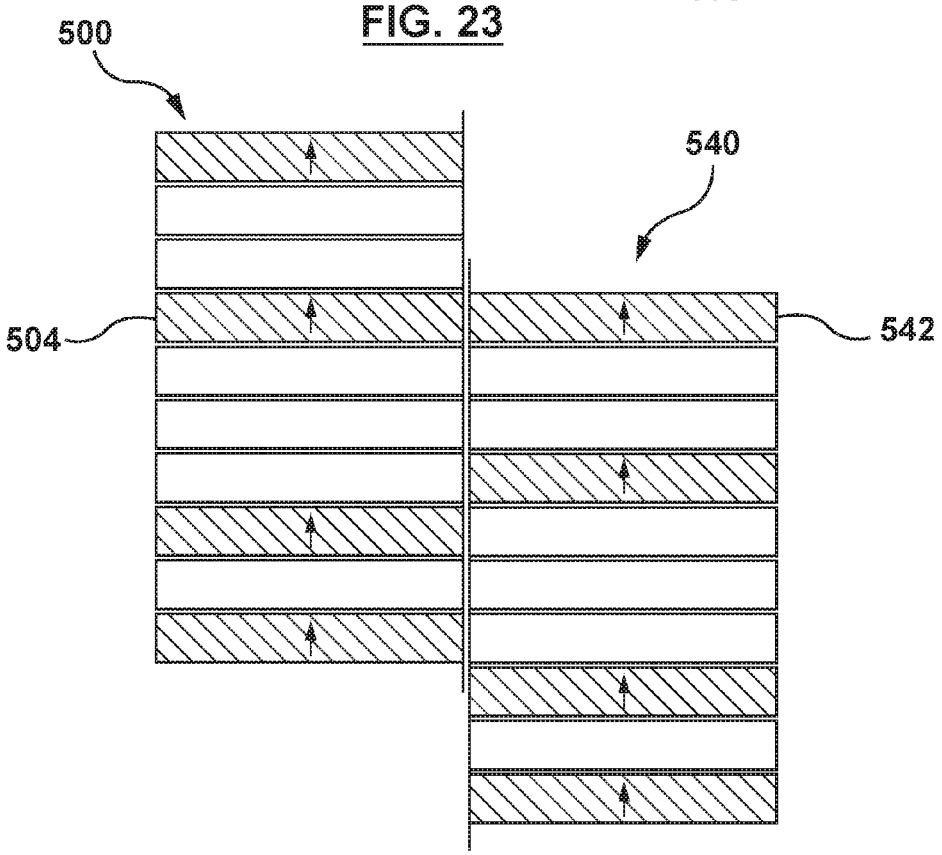
FIGS. 24 and 25 are schematic side elevation views of the spaced array of cylindrical magnets of FIG. 23 in two different misalignment positions with respect to a complementary spaced array of cylindrical magnets of a complementary connector.
Figure 25:
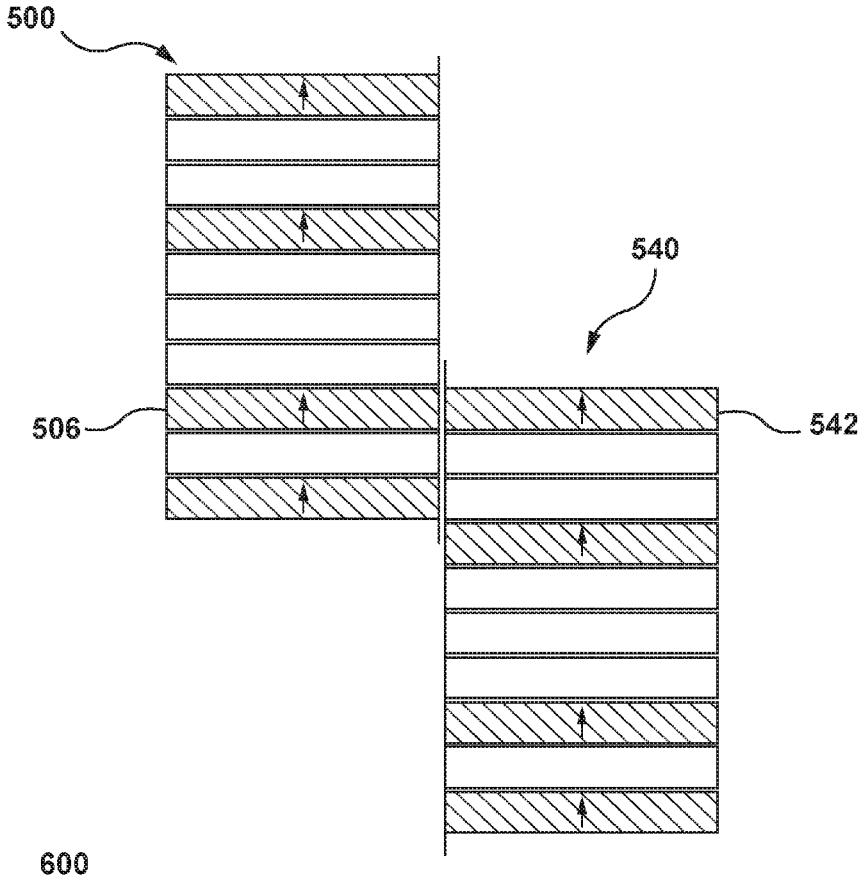

One possible longitudinal misalignment position of the cylindrical magnetic element 500 with a complementary cylindrical magnetic element 540 that yields a single aligned magnet pair is shown in FIG. 24. In this example, cylindrical magnet pair 504, 542 is aligned, and the remaining cylindrical magnets are misaligned. Another possible longitudinal misalignment position of cylindrical magnetic elements 500, 540 that yields a single aligned magnet pair is shown in FIG. 25. In this example, cylindrical magnet pair 506, 542 is aligned, and the remaining cylindrical magnets are misaligned. No longitudinally misaligned position of the cylindrical magnetic elements 500, 540 will produce more than a single aligned complementary magnet pair in this embodiment.

A similar effect may be achieved in three-magnet connector embodiments having designs including the following (using the textual expression notation specified above):

M:1:M:2:M

M:2:M:3:M

M:1:M:3:M

An enhanced longitudinal self-alignment effect may also be achieved by adjusting a height (i.e. thickness or longitudinal extent) of one or more magnets instead of, or in addition to, adjusting the height of the spacers. This is illustrated in FIG. 26.

Figure 26:
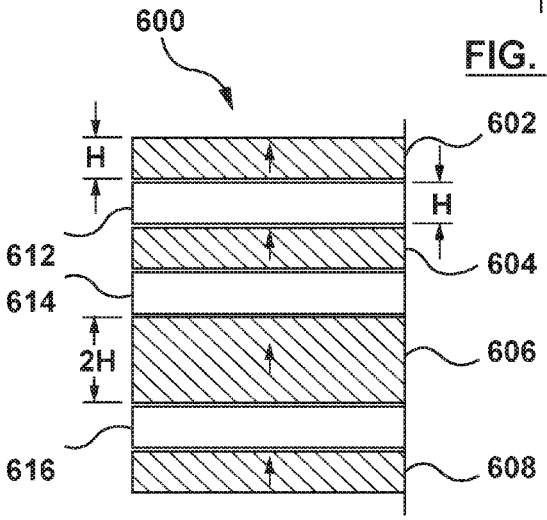
FIG. 26 is a schematic side elevation view of another example cylindrical magnetic element of a self-aligning connector having a spaced array of cylindrical magnet in which one magnet is thicker than the others.

FIG. 26 is a schematic depiction, in side elevation view, of yet another alternative cylindrical magnetic element 600 of a notional connector. Cylindrical magnetic element 600 comprises four cylindrical magnets 602, 604, 606 and 608 arranged coaxially. Cylindrical magnets 602, 604 and 608 are of equal size and shape and thus have uniform heights H. Cylindrical magnet 606 has a different height 2H from the other magnets, specifically one that is twice the height H of any other magnet. Each magnet is axial and has the same polarity. Three uniform spacers 612, 614 and 616, each of height H, are interleaved with the four cylindrical magnets.

When a cylindrical magnetic element comprises axial magnets, adjusting the height (thickness) of the magnets in the absence any spacers will suffice to enhance the longitudinal alignment effect. This is illustrated in FIG. 27.

Figure 27:
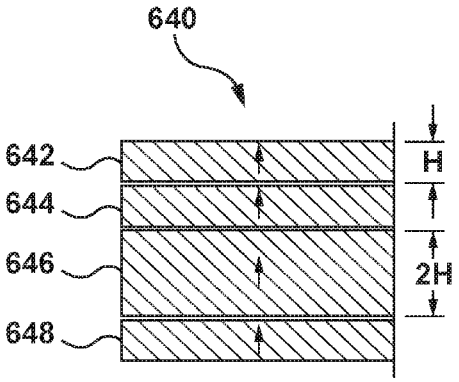
FIG. 27 is a schematic side elevation view of another example cylindrical magnetic element of a self-aligning connector having an unspaced array of cylindrical magnets in which one magnet is thicker than the others.

FIG. 27 is a schematic depiction, in side elevation view, of yet another alternative cylindrical magnetic element 640 of a notional connector. Cylindrical magnetic element 640 comprises four axial cylindrical magnets 642, 644, 646 and 648 arranged coaxially. Cylindrical magnets 602, 604 and 608 are of equal size and shape and thus have uniform heights H, whereas cylindrical magnet 606 has a different height 2H from the other magnets, specifically one that is twice the height H of any other magnet. Each magnet is axial and has the same polarity. The magnets are not spaced apart.

As discussed above, one or more self-aligning connectors, each having at least one cylindrical magnet, may be situated at a straight rounded edge of a device with the axis A of the cylindrical magnet(s) substantially parallel to that straight edge and, if more than one self-aligning connector is disposed along the same straight rounded edge, with the cylindrical magnets of the connectors along that edge being coaxial (see e.g. connectors 120A, 120B of FIG. 1 having common axis A parallel to edge 106). It will be appreciated that, when such self-aligning connectors are used to connect the device with another device having complementary self-aligning connectors at a straight rounded edge, the connectors may permit hinge-like relative movement of one device about straight rounded edge of the other while maintaining a physical interconnection between devices. That is, one of the devices may be pivoted or swung about the rounded edge of the other, in the manner of a hinge, without breaking the physical connection, possibly through an angle of up to 360 degrees or thereabouts. This is illustrated in FIGS. 28 and 29.

Figure 28:
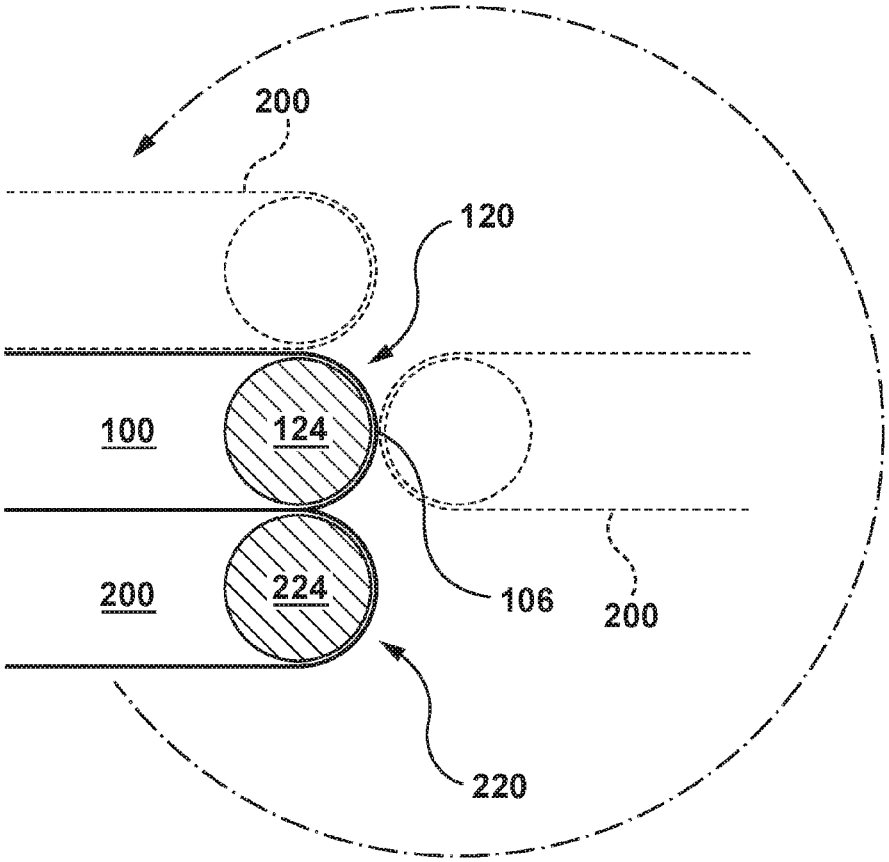
FIG. 28 is a schematic top view illustrating hinge-like pivoting of the device of FIG. 1 about an edge of a similar connected device without breaking a connection between self-aligning connectors of the respective devices.

FIG. 28 is a schematic depiction, in top view, of an exemplary device 100 having connector 120 as described above, physically (magnetically) interconnected with a complementary connector 220 of a similar device 200. As illustrated, the devices 100, 200 are initially stacked face-to-face, with connectors 120, 220 being in a connected state. FIG. 29 illustrates the devices 100, 200 of FIG. 28 in perspective view.

Figure 29:
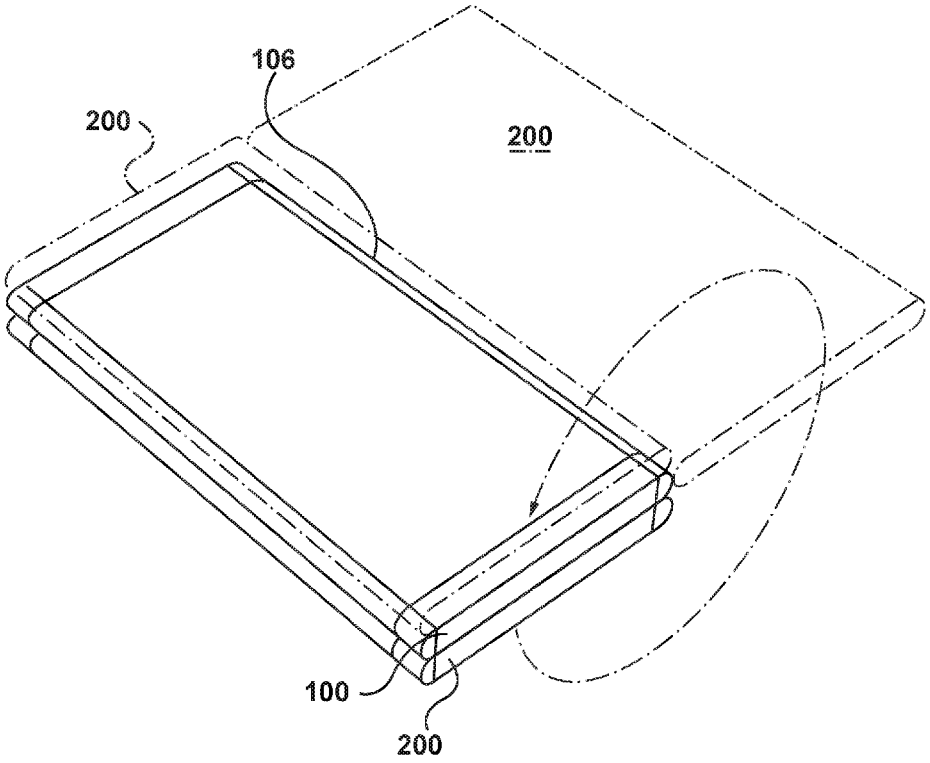
FIG. 29 is a perspective view illustrating the hinge-like pivoting motion shown in FIG. 28.

Device 200 may thereafter be pivoted or swung about the rounded edge 106 of the other device 100, in the manner of a hinge, until it ultimately achieves a back-to-back stacked relationship with device 100 (shown in dashed lines in FIGS. 28 and 29). Notably, this pivoting can be performed without breaking the physical (magnetically induced) connection between connectors 120, 220. In this example, the angle through which device 200 can be swung without breaking the connection certainly exceeds 270 degrees, and approaches, or is approximately equal to, 360 degrees.

It will be appreciated that, in the example embodiment of FIGS. 1-29, the device 100 incorporating the example self-aligning connectors 120 has a generally flat cuboid shape. This is not necessarily true of all embodiments. For example, one or more self-aligning connectors may be incorporated into a device having a cuboid shape that is not flat. This is illustrated in FIG. 30.

Figure 30:
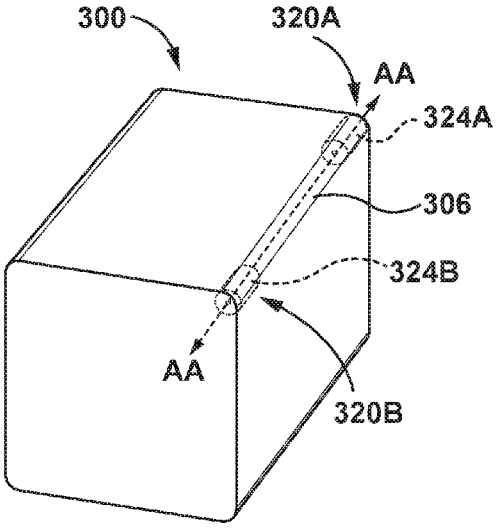
FIG. 30 is a perspective view of a different device having two self-aligning connectors spaced apart along an elongate rounded edge.

FIG. 30 is a perspective view of a device 300 having a generally cuboid or cube-like shape. The device 300 may for example be a radio, a camera, a speaker, or a memory storage device, to name but a few examples. The device 300 has a housing 302, which may be made from be made from a non-conductive material such as plastic or anodized metal. The housing 302 has a plurality of rounded edges, including an elongate, straight rounded edge 306 having a quarter-circular profile.

Two self-aligning connectors 320A, 320B (referred to generically and collectively as self-aligning connector(s) 320) are spaced apart along the straight rounded edge 306.

Each self-aligning connector 320A, 320B also includes a respective cylindrical magnetic element 324A, 324B (referred to collectively and generically as cylindrical magnetic element(s) 324). Each cylindrical magnetic element 324 comprises one or more cylindrical magnets. If more than one cylindrical magnet is used, the cylindrical magnets are arranged coaxially. The cylindrical magnetic element 324 produces the magnetic force that automatically aligns the connector 320 with a complementary connector, e.g. of another device, when the connectors are brought into proximity with one another.

Figure 31:
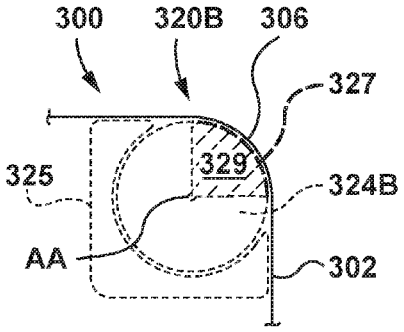
FIG. 31 is a schematic side view of one of the self-aligning connectors of FIG. 30 at the rounded edge of the device of FIG. 30.

The cylindrical magnet(s) comprising each self-aligning connector 320 may be rotatably or fixedly held in place within the housing 302 by a mounting structure 325, which is not expressly depicted in FIG. 30 but is shown in FIG. 31 (discussed below). The mounting structure 325 of the present embodiment mounts the magnet(s) of the relevant self-aligning connector so that an axis of the cylindrical magnet (or of a coaxially arranged array of cylindrical magnets) is substantially parallel to the straight rounded edge 306 at which the self-aligning connector is disposed. Using self-aligning connectors 320B as an example, the mounting structure 325 orients the cylindrical magnet(s) of the cylindrical magnetic element 324B so that an axis AA of the cylindrical magnet(s) is substantially parallel to straight rounded edge 306.

The mounting structure 325 (FIG. 31) is also configured to mount the cylindrical magnet(s) of the self-aligning connector 320B so that an axis of the cylindrical magnet(s) 324B is coaxial with an axis AA of the cylindrical magnet(s) 324A of any other self-aligning connector 320A disposed along the same straight rounded edge.

FIG. 31 is a side elevation view of a portion of device 300 showing an example self-aligning connector 320B of device 300. FIG. 31 schematically depicts, in dashed lines, the mounting structure 325 that mounts the cylindrical magnet(s) at the straight rounded edge 306. The mounting structure may take various forms and may be effected in different ways in different embodiments. The mounting structure 325B may for example be a framework, a cage, a partially or fully cylindrical receptacle or an adhesive. The mounting structure 325B may be attached to, or may form part of, the device housing 302. In some self-aligning connector embodiments, the mounting structure may be designed to allow the cylindrical magnet(s) comprising the cylindrical magnetic element to rotate with respect to the housing. For example, when a self-aligning connector includes a cylindrical magnet having a diametric magnetic orientation, the mounting structure may allow that magnet to rotate with respect to the housing, e.g. so that the correct pole presents itself at the curved profile of the straight rounded edge 306 (depending upon the polarity of the magnet of an approaching connector). In other self-aligning connector embodiments, the mounting structure may be designed to fix the cylindrical magnet(s) with respect to the housing. For example, when a self-aligning connector includes a cylindrical magnet having an axial magnetic orientation, the mounting structure may fix that magnet with respect to the housing.

Referring to FIG. 31, it can be seen that a curved face 327 of the cylindrical magnet(s) comprising cylindrical magnetic element 324B is substantially coextensive with the curved profile of the rounded edge 306. In some embodiments, this may promote a strong magnetic attraction force over the entirety of, or a portion of, the curved profile of the rounded edge 306.

In the present embodiment, a quarter-circular curved profile of the rounded edge 306 is substantially coextensive with a quarter-cylindrical section 329 of the cylindrical magnet(s) comprising cylindrical magnetic element 324B. In some embodiments, this may promote a strong magnetic attraction force over the entirety of, or a portion of, the curved profile of the rounded edge 306.

The rounded edge 306 of the housing 302 of the present embodiment wraps around the curved face 327 of the cylindrical magnet(s) of cylindrical magnetic element 324B. As such, the cylindrical magnet(s) of cylindrical magnetic element 324B may be considered to be encased by the housing 302 in this embodiment. To the extent that the housing 302 is watertight, then the cylindrical magnet(s) and/or the mounting structure 325 may be protected from possible water damage as a result.

The other self-aligning connector 320A may have a similar design to self-aligning connector 320B.

The cylindrical magnet(s) comprising each cylindrical magnetic element 324 may include one or more diametric cylindrical magnets, one or more axial cylindrical magnets, or a combination of the two.

Figure 32:
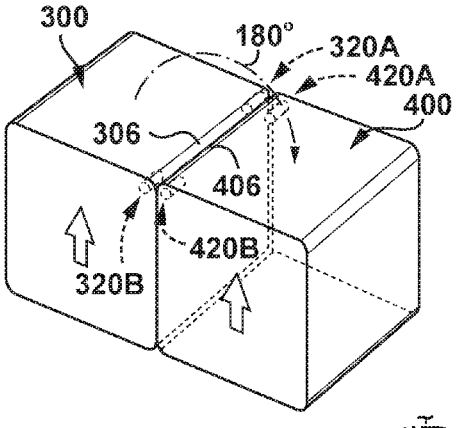
FIGS. 32 and 33 provide a perspective view illustrating hinge-like pivoting motion of the device of FIG. 30 about an edge of a similar connected device without breaking a connection between self-aligning connectors of the respective devices.

FIG. 32 is a perspective view of the exemplary device 300 described above in which the straight rounded edge 306 is physically interconnected with a rounded edge 406 of a similar device 400 by operation of self-aligning connectors 320. As illustrated, the devices 300, 400 are side-to-side, with connectors 320A, 320B of device 300 being connected with complementary connectors 420A, 420B, respectively, of device 400.

Figure 33:
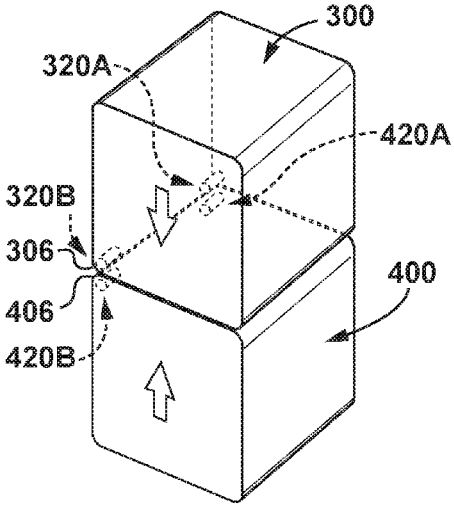
Figure 34:
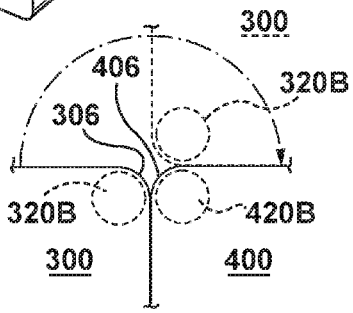
FIG. 34 provides a schematic side view of the hinge-like pivoting motion shown in FIGS. 32 and 33.

Device 300 may thereafter be pivoted or swung about the rounded edge 406 of the other device 400, in the manner of a hinge, until device 300 ultimately achieves a stacked relationship with device 400. This is shown in the perspective view of FIG. 33 and in the schematic depiction of FIG. 34 (the conventions of the latter figure being similar to those of FIG. 28, discussed above). Notably, this pivoting can be performed without breaking the magnetic connection between connectors 320, 420 and without breaking the physical (magnetically induced) connection between edges 306, 406. In this example, device 300 can be swung through an angle of 180 degrees without breaking the connection.

Various alternative embodiments are possible.

At least some of the self-aligning connector embodiments described herein have electrical contacts designed to carry one or more electrical signals between complementary connectors. It will be appreciated that some self-aligning connector embodiment may lack such electrical contacts. For example, in some embodiments, electrical interconnection may be achieved between magnetically connected devices without electrical contacts, e.g. wirelessly or through optical signaling. Alternatively, some self-aligning connector embodiments may be used strictly for physical interconnection of devices. Any of the self-aligning connector embodiments described in this paragraph could be embedded at an edge of a device so as not to be visible to the naked eye.

To the extent that a self-aligning connector is situated at a straight rounded edge of a device, that rounded edge need not necessarily have a semi-circular or quarter-circular profile or cross-sectional shape (e.g. as shown in FIGS. 4 and 32). In some embodiments, the profile of a rounded edge of a device may be otherwise partly circular. In other embodiments, the rounded edge may not have a partly circular cross-sectional profile at all, but may instead have another rounded cross-sectional shape, such as semi-elliptical or partly elliptical. The profile may determine or limit the angle through which the device may be swung while maintaining the connector in a connected state.

Figure 35:
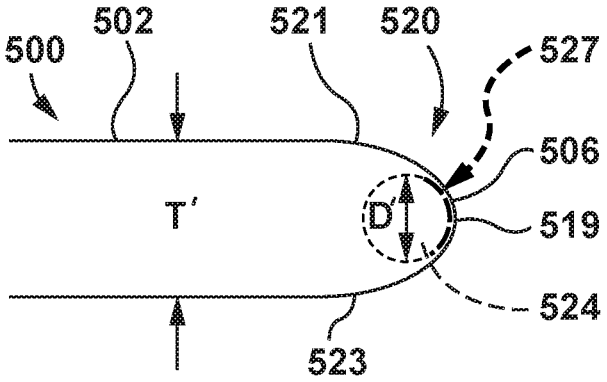
FIG. 35 is a schematic view of an alternative self-aligning connector embodiment at a rounded device edge having a parabolic shape.

For example, FIG. 35 schematically depicts a portion of an alternative device embodiment 500 having a generally flat cuboid shape whose housing 502 defines a straight rounded edge 506 with a parabolic profile. In this example, the cylindrical magnet(s) 524 of a self-aligning connector 520 disposed at the rounded edge 506 has (have) a diameter D' that is less than a thickness T' of the device 500.

In the embodiment of FIG. 35, the straight rounded edge 506 of the housing 502 wraps around a curved face of the cylindrical magnet. The curved face 527 of the cylindrical magnet(s) 524 may be considered substantially coextensive with a curved profile of a distal end 519 of the straight rounded edge 506 of the housing 502. The radius of curvature of the cylindrical magnet(s) 524 may be considered to be substantially equal to a radius of curvature of the straight rounded edge 506 in at least some areas of the edge 506 at the narrow distal tip area 519, but not in the the proximal transition portions 521, 523 of the straight rounded edge 506.

Figure 36:
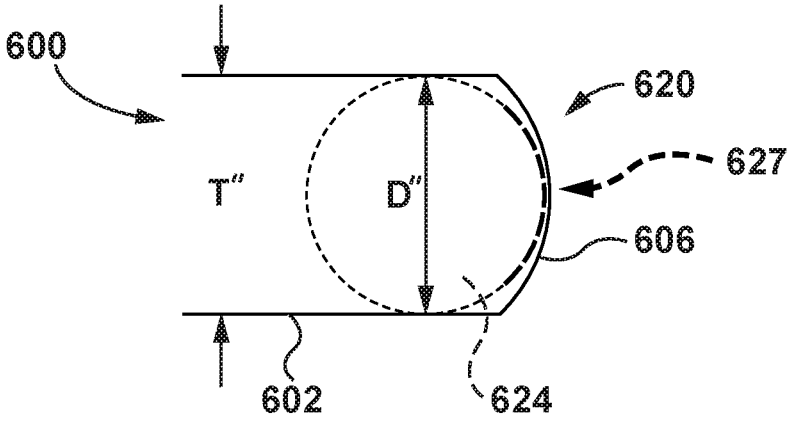
FIG. 36 is a schematic view of another alternative self-aligning connector embodiment at a rounded device edge having a blunt shape.

FIG. 36 schematically depicts a device 600 having a straight rounded edge 606 with a different profile, namely one that is part-circular and blunt. In this embodiment, the cylindrical magnet(s) 624 of a self-aligning connector 620 disposed at the edge 606 has (have) a diameter D" that substantially equal to a thickness T" of the device 600. As in the embodiment discussed above, the straight rounded edge 606 of the housing 602 in this embodiment may wrap around a curved face 627 of the cylindrical magnet(s) 624, albeit less tightly than in the embodiment shown in FIG. 4 for example. Moreover, the curved face 627 of the cylindrical magnet(s) 624 (FIG. 35) may be considered substantially coextensive with the curved, part-circular profile of the straight rounded edge 606 of the housing 602 or a substantial portion thereof. However, the cylindrical magnet(s) 624 may be considered to have a radius of curvature that is less than, and thus not substantially equal to, a radius of curvature of the straight rounded edge 606. Nevertheless, the connector 620 may still provide acceptable connection performance (e.g. maintaining a physical connection with a complementary connector even over some degree of hinge-like relative motion of the devices).

At least some of the self-aligning connector embodiments discussed above employ a cylindrical magnetic element that is fixedly or rotatably held in a housing of a device, so that the axis A of the cylindrical magnetic element is substantially parallel, and in fixed relation, to a straight rounded device edge (see e.g. connector 120B of FIG. 1). It will be appreciated that, in some embodiments, the cylindrical magnetic element may occupy a hollow at a device edge and may be movable within the hollow between a stowed position and a deployed position. In such cases, the axis of the cylindrical magnet(s) comprising the cylindrical magnetic element may be movable relative to the straight rounded device edge.

Various self-aligning connector embodiments described above employ spacers for spacing apart cylindrical magnets into a spaced array. It will be appreciated that spacers are but one form of spacing structure and that other non-magnetic spacing structure may be used to space apart the cylindrical magnets of other embodiments. For example, a framework or sleeve around an array of cylindrical magnets, with recesses or teeth for retaining or clamping each magnet in place relative to the others, could be used.

In any of the connector embodiments described above, the cylindrical magnetic element may be hollow. For example, each of the cylindrical magnets and spacers of any of the above-described spaced arrays of cylindrical magnets may have a central hole extending therethrough to define an annular shape, so that the magnets and spacers collectively form a longitudinal channel, which may be cylindrical in shape. The use of annular magnets may advantageously reduce a weight of the connector in comparison to an embodiment lacking such magnets. The definition of a longitudinal channel may facilitate insertion of a longitudinal complementary magnetic plug into the channel, in a plug-and-jack arrangement, e.g. to facilitate electrical connectivity between the two using conductive magnets.

Any of the cylindrical magnets contemplated herein may be electromagnets.

The following clauses provided a further description of example embodiments.

Clause 1. A self-aligning connector comprising: a plurality of cylindrical magnets arranged coaxially; non-magnetic spacing structure for spacing apart at least some of the cylindrical magnets into a spaced array of cylindrical magnets, wherein the spaced array of cylindrical magnets is for magnetically engaging complementary magnets of another connector to align and connect the connectors.

Clause 2. The self-aligning connector of clause 1 wherein the spacing structure comprises one or more spacers between neighboring ones of the cylindrical magnets, each spacer being made from a non-magnetic and non-ferrous material.

Clause 3. The self-aligning connector of clause 1 wherein a spacing of the cylindrical magnets within the spaced array is irregular.

Clause 4. The self-aligning connector of clause 1 wherein the spaced array of cylindrical magnets is longitudinally symmetric.

Clause 5. The self-aligning connector of clause 1 wherein the spaced array of cylindrical magnets is longitudinally asymmetric.

Clause 6. The self-aligning connector of clause 1 wherein the plurality of cylindrical magnets comprises at least three cylindrical magnets, wherein the other connector has a like plurality of complementary magnets in the same spaced array as in the self-aligning connector, and wherein a spacing of the cylindrical magnets of the self-aligning connector is such that, upon longitudinal misalignment of the self-aligning connector with the other connector, at most one of the cylindrical magnets of the self-aligning connector will align with a complementary magnet of the other connector, regardless of the degree of longitudinal misalignment of the self-aligning connector with the other connector.

Clause 7. The self-aligning connector of clause 6 wherein the plurality of cylindrical magnets comprises four cylindrical magnets of equal height, wherein the spacing structure creates a first space, a second space, and a third space respectively between each neighboring pair of of the three distinct neighboring pairs of cylindrical magnets comprising the four cylindrical magnets arranged coaxially, wherein the longitudinal extent of the first space is equal to the height of one cylindrical magnet, and wherein the second and third spaces are twice and three times as large, respectively, as the first space.

Clause 8. The self-aligning connector of clause 1 wherein the plurality of cylindrical magnets comprises at least three cylindrical magnets, wherein the other connector has a like plurality of complementary magnets spaced as in the spaced array of the self-aligning connector, and wherein the spacing of the cylindrical magnets of the self-aligning connector is such that, upon longitudinal misalignment of the self-aligning connector with the other connector, at most one-half of the cylindrical magnets of the self-aligning connector will align with a complementary magnet of the other connector, regardless of the degree of longitudinal misalignment of the self-aligning connector with the other connector.

Clause 9. The self-aligning connector of clause 8 wherein the plurality of magnets comprises four cylindrical magnets of equal height, wherein the spacing structure creates a first space, a second space, and a third space respectively between neighboring magnets of the distinct three neighboring pairs of cylindrical magnets comprising the four cylindrical magnets arranged coaxially, wherein the longitudinal extent of each of the first space and the second space is equal to the height of one cylindrical magnet, and wherein the third space is twice as large as the first or second space.

Clause 10. The self-aligning connector of clause 1 wherein the plurality of cylindrical magnets includes at least one axial cylindrical magnet and at least one diametric cylindrical magnet.

Clause 11. The self-aligning connector of clause 1 wherein the plurality of cylindrical magnets includes cylindrical magnets of different thicknesses.

Clause 12. A self-aligning connector comprising: a plurality of annular magnets arranged coaxially; spacing structure for spacing apart the annular magnets into a spaced array of annular magnets, the spaced array of annular magnets and the spacing structure collectively forming a longitudinal channel, wherein the spaced array of annular magnets is for magnetically engaging complementary magnets of an other connector to align and connect the self-aligning connector with the other connector.

Clause 13: The self-aligning connector of clause 12 wherein the spacing structure comprises one or more annular spacers arranged coaxially with the plurality of annular magnets.

Other modifications may be made within the scope of the following claims.

What is claimed is:

1. A device comprising:

a housing having a generally flat cuboid shape including a convex sidewall portion;

a self-aligning connector at the convex sidewall portion of the housing, the self-aligning connector comprising a cylindrical magnet oriented with its axis substantially parallel to the convex sidewall portion, the cylindrical magnet for magnetically engaging a magnet of an other connector so as to align and connect the self-aligning connector with the other connector, wherein the convex sidewall portion of the housing has a semicircular profile that is substantially coextensive with a semicylindrical half of the cylindrical magnet, and wherein the other connector is at a convex sidewall portion of an object, wherein the convex sidewall portion of the object has a semicircular profile, and wherein, upon physical connection of the self-aligning connector with the other connector, the device is pivotable more than 270 degrees about the convex sidewall portion of the object without breaking the physical connection between the self-aligning connector and the other connector.

2. The device of claim 1 wherein a curved face of the cylindrical magnet is substantially coextensive with a curved profile of the convex sidewall portion of the housing.

3. The device of claim 1 wherein the convex sidewall portion of the housing wraps around a curved face of the cylindrical magnet.

4. The device of claim 1 wherein the cylindrical magnet has a radius of curvature that is substantially equal to a radius of curvature of the convex sidewall portion.

5. The device of claim 1 wherein the cylindrical magnet has an axial magnetic orientation and is fixed with respect to the housing.

6. The device of claim 1 wherein the cylindrical magnet has a diametric magnetic orientation and is rotatable along its axis with respect to the housing.

7. A device comprising:

a housing having a generally cuboid shape including a rounded corner adjoining two perpendicular faces;

a self-aligning connector at the rounded corner of the housing, the self-aligning connector comprising a cylindrical magnet oriented with its axis substantially parallel to the rounded corner, the cylindrical magnet for magnetically engaging a magnet of an other connector so as to align and connect the self-aligning connector with the other connector, wherein the rounded corner of the housing has a quarter-circular profile that is substantially coextensive with a quarter-cylindrical section of the cylindrical magnet, and wherein the other connector is at a rounded corner of an object, wherein the rounded corner of the object has a quarter-circular profile, and wherein, upon physical connection of the self-aligning connector with the other connector, the device is pivotable by 180 degrees about the rounded corner of the object without breaking the physical connection between the self-aligning connector and the other connector.

8. A self-aligning connector for use in a device housing having a generally flat cuboid shape including a convex sidewall portion, the self-aligning connector comprising:

a cylindrical magnet for magnetically engaging a magnet of an other connector so as to align and connect the self-aligning connector with the other connector; and mounting structure configured to mount the cylindrical magnet at the convex sidewall portion of the device housing with an axis of the cylindrical magnet being substantially parallel to the convex sidewall portion of the device housing, wherein the cylindrical magnet has a diametric magnetic orientation and wherein the mounting structure is configured to allow the cylindrical magnet to rotate along its axis with respect to the device housing.

9. The self-aligning connector of claim 8 wherein the mounting structure is configured to position the cylindrical magnet with respect to the convex sidewall portion so that a curved face of the cylindrical magnet is substantially coextensive with a curved profile of the convex sidewall portion of the device housing.

10. The self-aligning connector of claim 8 wherein the mounting structure is configured to position the cylindrical magnet so that the convex sidewall portion of the device housing wraps around at least a portion of a curved face of the cylindrical magnet.

11. The self-aligning connector of claim 8 wherein the cylindrical magnet has a radius of curvature that is substantially equal to a radius of curvature of the convex sidewall portion of the device housing.

12. The self-aligning connector of claim 8 wherein the convex sidewall portion of the device housing has a semicircular profile and wherein the mounting structure is configured to position the cylindrical magnet with respect to the convex sidewall portion so that a semicylindrical half of the cylindrical magnet is substantially coextensive with the semicircular profile of the convex sidewall portion of the device housing.

13. A device comprising a housing having a generally flat cuboid shape with a convex sidewall portion, the convex sidewall portion of the housing having mounted therein the self-aligning connector of claim 8.

14. A device comprising a housing having a generally flat cuboid shape including a convex sidewall portion, the convex sidewall portion of the housing having mounted therein two self-aligning connectors as recited in claim 8, the two self-aligning connectors being spaced apart from one another along the convex sidewall portion of the housing.

15. The device of claim 14 wherein the mounting structure of each of the self-aligning connectors is configured to position the respective cylindrical magnet with respect to the convex sidewall portion so that a curved face of the cylindrical magnet is substantially coextensive with a curved profile of the convex sidewall portion of the housing.

16. The device of claim 14 wherein the mounting structure of each of the self-aligning connectors is configured to position the respective cylindrical magnet with respect to the convex sidewall portion so that the convex sidewall portion of the housing wraps around at least a portion of a curved face of the cylindrical magnet.

17. The device of claim 14 wherein the cylindrical magnet of each of the self-aligning connectors has a radius of curvature that is substantially equal to a radius of curvature of the convex sidewall portion of the housing.

18. The device of claim 14 wherein the cylindrical magnet of each of the self-aligning connectors has a diameter that is slightly smaller than a thickness of the housing.

19. The device of claim 14 wherein the convex sidewall portion of the housing has a semicircular profile that is substantially coextensive with a semicylindrical half of the cylindrical magnet of each of the self-aligning connectors.

20. The device of claim 14 wherein the convex sidewall portion of the housing has a quarter-circular profile that is substantially coextensive with a quarter-cylindrical section of the cylindrical magnet of each of the self-aligning connectors.

21. A device comprising:

a housing having a generally flat cuboid shape including a convex sidewall portion;

a self-aligning connector at the convex sidewall portion of the housing, the self-aligning connector comprising a magnetic cylinder oriented with its axis substantially parallel to the convex sidewall portion, the magnetic cylinder for magnetically engaging a magnet of an other connector so as to align and connect the self-aligning connector with the other connector, wherein the convex sidewall portion of the housing has a semicircular profile that is substantially coextensive with a semicylindrical half of the magnetic cylinder, and wherein the other connector is at a convex sidewall portion of an object, wherein the convex sidewall portion of the object has a semicircular profile, and wherein, upon physical connection of the self-aligning connector with the other connector, the device is pivotable more than 270 degrees about the convex sidewall portion of the object without breaking the physical connection between the self-aligning connector and the other connector.

22. The device of claim 21 wherein a curved face of the magnetic cylinder is substantially coextensive with a curved profile of the convex sidewall portion of the housing.

23. The device of claim 21 wherein the convex sidewall portion of the housing wraps around a curved face of the magnetic cylinder.

24. The device of claim 21 wherein the magnetic cylinder has a radius of curvature that is substantially equal to a radius of curvature of the convex sidewall portion.

25. The device of claim 21 wherein the magnetic cylinder has an axial magnetic orientation and is fixed with respect to the housing.

26. The device of claim 21 wherein the magnetic cylinder has a diametric magnetic orientation and is rotatable along its axis with respect to the housing.

27. A self-aligning connector for use in a device housing having a generally flat cuboid shape including a convex sidewall portion, the self-aligning connector comprising:

a magnetic cylinder for magnetically engaging a magnet of an other connector so as to align and connect the self-aligning connector with the other connector; and mounting structure configured to mount the magnetic cylinder at the convex sidewall portion of the device housing with an axis of the magnetic cylinder being substantially parallel to the convex sidewall portion of the device housing, wherein the magnetic cylinder has a diametric magnetic orientation and wherein the mounting structure is configured to allow the magnetic cylinder to rotate along its axis with respect to the device housing.

28. The self-aligning connector of claim 27 wherein the mounting structure is configured to position the magnetic cylinder with respect to the convex sidewall portion so that a curved face of the magnetic cylinder is substantially coextensive with a curved profile of the convex sidewall portion of the device housing.

29. The self-aligning connector of claim 27 wherein the mounting structure is configured to position the magnetic cylinder so that the convex sidewall portion of the device housing wraps around at least a portion of a curved face of the magnetic cylinder.

30. The self-aligning connector of claim 27 wherein the magnetic cylinder has a radius of curvature that is substantially equal to a radius of curvature of the convex sidewall portion of the device housing.

31. The self-aligning connector of claim 27 wherein the convex sidewall portion of the device housing has a semicircular profile and wherein the mounting structure is configured to position the magnetic cylinder with respect to the convex sidewall portion so that a semicylindrical half of the magnetic cylinder is substantially coextensive with the semicircular profile of the convex sidewall portion of the device housing.

* * * * *